US006390083B2

(12) United States Patent
Oki et al.

(10) Patent No.: US 6,390,083 B2
(45) Date of Patent: May 21, 2002

(54) CONTROL APPARATUS FOR INTERNAL COMBUSTION ENGINE

(75) Inventors: Hideyuki Oki; Shinichi Kitajima; Fumihiko Konno; Atsushi Matsubara; Teruo Wakashiro; Hideyuki Takahashi; Hironao Fukuchi, all of Wako; Yasuo Nakamoto, Haga-gun, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/739,630

(22) Filed: Dec. 20, 2000

(30) Foreign Application Priority Data

Dec. 20, 1999 (JP) ..... 11-361924
Dec. 20, 1999 (JP) ..... 11-361926

(51) Int. Cl.[7] ..... F02M 25/08
(52) U.S. Cl. ..... 123/698; 123/520
(58) Field of Search ..... 123/339.1, 339.12, 123/339.14, 339.15, 480, 486, 520, 516, 680, 681, 698; 701/103, 104

(56) References Cited

U.S. PATENT DOCUMENTS 5,203,300 A * 4/1993 Orzel ..... 123/339
5,438,967 A * 8/1995 Ito ..... 123/339.12
5,520,160 A * 5/1996 Aota et al. ..... 123/675
5,699,778 A * 12/1997 Muraguchi et al. ..... 123/698
5,746,187 A * 5/1998 Ninomiya et al. ..... 123/520
5,924,956 A * 7/1999 Kobayashi et al. ..... 477/111
5,967,125 A * 10/1999 Morikawa ..... 123/520
5,988,150 A * 11/1999 Osanai ..... 123/698
6,039,032 A * 3/2000 Morikawa et al. ..... 123/520

FOREIGN PATENT DOCUMENTS

JP 192858 * 11/1984 ..... F02M/25/08
JP 248638 * 10/1990 ..... F02D/41/14
JP 117234 * 4/1994 ..... F01N/3/22

* cited by examiner

*Primary Examiner*—Tony M. Argenbright
*Assistant Examiner*—Hai Huyne
(74) *Attorney, Agent, or Firm*—Arent Fox Kintner Plotkin & Kahn, PLLC

(57) ABSTRACT

The control apparatus for an internal combustion engine of the present invention comprises: a fuel supply device for supplying fuel to the internal combustion engine; a fuel tank for retaining fuel; a purge device for purging fuel vapor, produced in the fuel tank, into an intake system of the internal combustion engine; a purge correction amount updating device for calculating a purge correction amount for correcting an amount of fuel to be supplied by the fuel supply device, depending on the amount of fuel vapor purged by the purge device; a target air-fuel ratio setting device for setting a target air-fuel ratio depending on a running state of the internal combustion engine; and an update amount setting device for updating the purge correction amount depending on the target air-fuel ratio set by the target air-fuel ratio setting device.

15 Claims, 12 Drawing Sheets

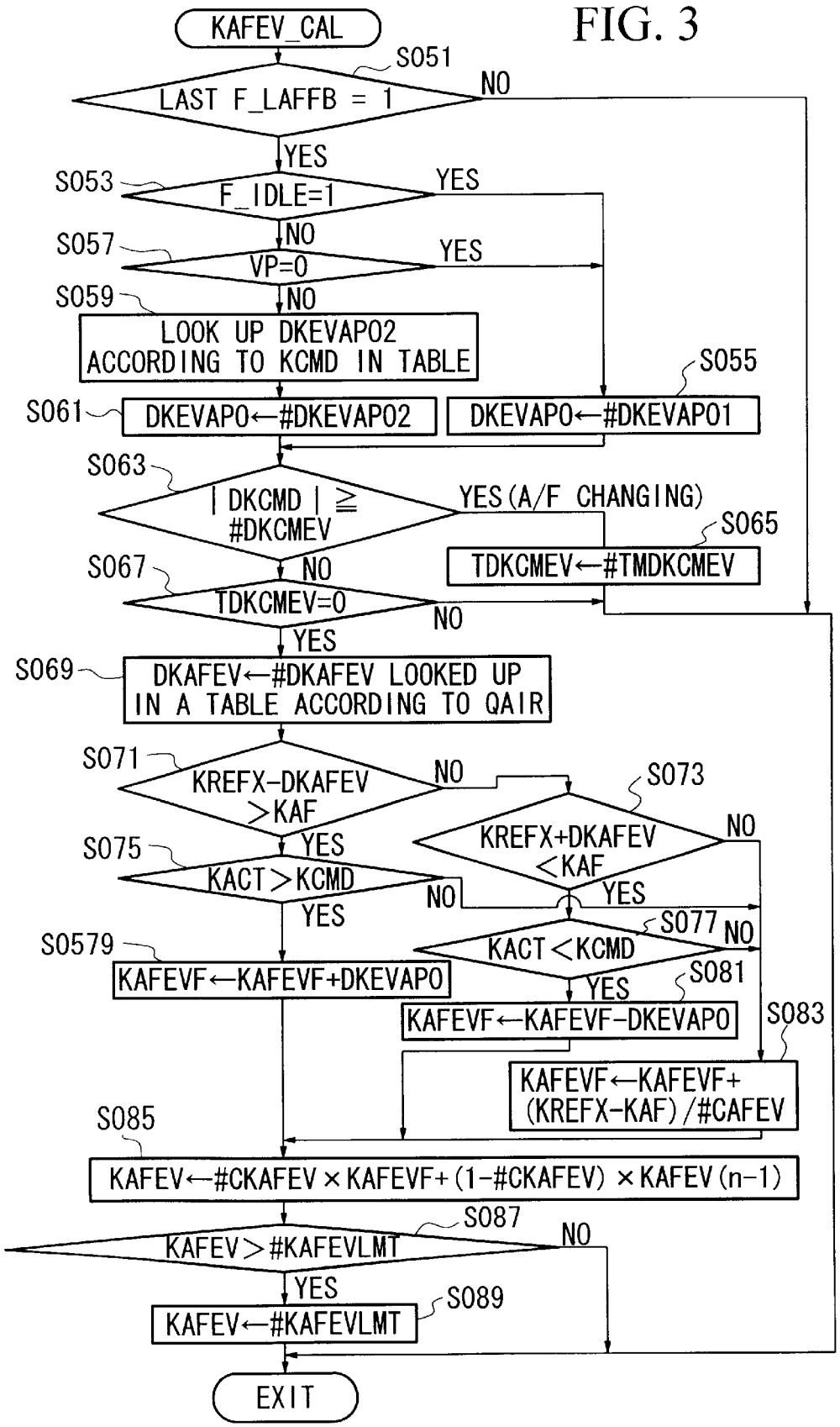
FIG. 3
KAFEV_CAL
S051
LAST F_LAFFB = 1
NO
YES
S053
F_IDLE=1
YES
NO
S057
VP=0
YES
NO
S059
LOOK UP DKEVAPO2 ACCORDING TO KCMD IN TABLE
S055
S061
DKEVAPO←#DKEVAPO2
DKEVAPO←#DKEVAPO1
S063
| DKCMD | ≧ #DKCMEV
YES (A/F CHANGING)
S065
TDKCMEV←#TMDKCMEV
S067
NO
TDKCMEV=0
NO
YES
S069
DKAFEV←#DKAFEV LOOKED UP IN A TABLE ACCORDING TO QAIR
S071
KREFX-DKAFEV >KAF
NO
S073
KREFX+DKAFEV <KAF
NO
YES
S075
KACT>KCMD
NO
YES
YES
S077
KACT<KCMD
NO
S0579
KAFEVF←KAFEVF+DKEVAPO
YES
S081
KAFEVF←KAFEVF-DKEVAPO
S083
KAFEVF←KAFEVF+ (KREFX-KAF)/#CAFEV
S085
KAFEV←#CKAFEV×KAFEVF+(1-#CKAFEV)×KAFEV(n-1)
S087
KAFEV>#KAFEVLMT
NO
YES
S089
KAFEV←#KAFEVLMT
EXIT

CONTROL APPARATUS FOR INTERNAL COMBUSTION ENGINE

BACKGROUND OF THE INVENTION

1. Field of the Invention

The present invention relates to a control apparatus for an internal combustion engine, which controls the internal combustion engine, and, more particularly, to the control that is executed at the time of purging vaporized fuel or fuel vapor, produced in a fuel tank, into the intake system of the internal combustion engine.

2. Description of the Related Art

Some internal combustion engines comprise fuel supply means for supplying fuel for generating power to the internal combustion engine, a fuel tank for retaining fuel to be supplied to the internal combustion engine by the fuel supply means, and purge means for purging fuel vapor, produced in the fuel tank, into the intake system of the internal combustion engine. Such an internal combustion engine is disclosed in, for example, Japanese Patent Application, First Publication No. Hei 8-338290.

In the conventional internal combustion engines, a correction amount for correcting the amount of fuel is incremented or decremented by a given amount. When the purge amount changes suddenly due to a change in the running state of the internal combustion engine, therefore, the correction of the amount of fuel corresponding to the purge amount may not be carried out adequately so that the exhaust component characteristic may deteriorate.

When the load varies while the internal combustion engine is idling, the fuel may not be corrected adequately while the purge amount changes in accordance with the change in the load. As a result, the air-fuel ratio becomes lean, making the running of the engine unstable.

When a large correction amount is updated while the internal combustion engine is idling, the running of the engine may become unstable due to a change in the amount of fuel supply. If the correction amount to be updated is made small, the correction cannot properly respond to the influence of purging when the internal combustion engine is in states other than the idle state. In this case, the exhaust component characteristic may deteriorate.

The control apparatus for the conventional internal combustion engine uses a purge cut solenoid valve (hereinafter referred to as a solenoid). The solenoid controls the amount of vaporized fuel or fuel vapor, produced in a fuel tank and to be supplied to the intake system, and calculates a purge correction coefficient for decreasing the amount of fuel to be supplied from an injector, thereby preventing the over-rich state in the cylinder.

As the vaporized fuel supplied into the cylinders is increased, the purge correction coefficient for the calculation of the correction purge amount is increased, and the amount of fuel to be supplied from the injector is decreased.

In this case, the purge correction coefficient is controlled depending on the opening degree of the solenoid.

When the factor of the purge correction coefficient for determining the updating amount of the purge correction amount is always fixed, there are the problems described below.

When the factor is set to be large, based on a high target air-fuel ratio, the output significantly varies while in a lean-burn state, in which the combustion is unstable, thereby degrading the driveability. When the factor is set to be small, based on a low target air-fuel ratio, the follow-up control for following the variation of the purging is degraded.

When the control apparatus fully closes the opened solenoid, the purge correction coefficient is immediately set to 0. Therefore, the vaporized fuel remaining between the solenoid and the intake manifold may flow into the cylinder, thereby causing an over-rich state.

SUMMARY OF THE INVENTION

Accordingly, it is an object of the present invention to provide a control apparatus for an internal combustion engine which can execute finer correction control of the fuel supply means for the purge amount of fuel vapor.

To achieve the above object, according to one aspect of this invention, there is provided a control apparatus for an internal combustion engine, which comprises an internal combustion engine; fuel supply means (fuel injection valves 12 in a preferred embodiment) for supplying fuel to the internal combustion engine; a fuel tank (fuel tank 41 in the embodiment) for retaining fuel to be supplied to the internal combustion engine by the fuel supply means; purge means (fuel vapor processing device 40 in the embodiment) for purging fuel vapor, produced in the fuel tank, into an intake system of the internal combustion engine; air-fuel ratio detection means (LAF sensor 17 in the embodiment), provided in an exhaust system of the internal combustion engine, for detecting an air-fuel ratio (real air-fuel ratio coefficient KACT in the embodiment); a target air-fuel ratio setting means (ECU 5 in the embodiment) for setting a target air-fuel ratio (target air-fuel ratio coefficient KCMD in the embodiment) in accordance with the running state of the internal combustion engine; update amount setting means (determination in step S407 and processes of steps S422 and S423 all performed by the ECU 5 in the embodiment) for setting the update amount (update amount DKEVACT in the embodiment) which becomes larger as a deviation between the air-fuel ratio detected by the air-fuel ratio detection means and the target air-fuel ratio becomes larger; and purge correction amount updating means (processes of steps S023 and S025 performed by the ECU 5 in the embodiment) for updating a purge correction amount (purge correction coefficient KAFEVACT in the embodiment) for correcting an amount of fuel (fuel injection time TOUT in the embodiment) with the update amount set by the update amount setting means.

With the above structure, when a deviation between the real air-fuel ratio and the target air-fuel ratio is large, the update amount setting means sets a large update amount with which the purge correction amount updating means updates the purge correction amount for correcting the amount of fuel. Even when the purge amount changes drastically due to a change in the running state of the internal combustion engine, therefore, correction of the fuel amount corresponding to the purge amount is carried out properly. This prevents the exhaust component characteristic from deteriorating.

According to another aspect of this invention, there is provided a control apparatus for an internal combustion engine, which comprises an internal combustion engine; fuel supply means (fuel injection valves 12 in the embodiment) for supplying fuel to the internal combustion engine; a fuel tank (fuel tank 41 in the embodiment) for retaining fuel to be supplied to the internal combustion engine by the fuel supply means; purge means (fuel vapor processing device 40 in the embodiment) for purging fuel vapor, produced in the fuel tank, into an intake system of the internal combustion engine; idle determination means (determination in step S401 by the ECU 5 in the embodiment) for determining whether the internal combustion engine is in an idle state or not; load change detection means (determinations in steps S403 and S404 by the ECU 5 in the embodiment) for detecting a change in a load of the internal combustion engine; and purge-correction-amount initialization means (processes of steps S406, S023 and S025 performed by the ECU 5 in the embodiment) for initializing a purge correction amount (purge correction coefficient KAFEVACT in the embodiment) for correcting the amount of fuel (fuel injection time TOUT in the embodiment) when the idle determination means has determined that the internal combustion engine is in the idle state and the load change detection means has detected a change in the load.

With the above structure, when the idle determination means has determined that the internal combustion engine is in an idle state and the load change detection means has detected a change in the load, the purge-correction-amount initialization means initializes the purge correction amount for correcting the amount of fuel. In the case where the load varies in the idle state, even when the purge amount varies in accordance with the change in the load, the fuel amount can be corrected adequately to prevent the air-fuel ratio from becoming lean. This prevents the running of the engine from becoming unstable.

According to a further aspect of this invention, there is provided a control apparatus for an internal combustion engine, which comprises an internal combustion engine; fuel supply means (fuel injection valves 12 in the embodiment) for supplying fuel to the internal combustion engine; a fuel tank (fuel tank 41 in the embodiment) for retaining fuel to be supplied to the internal combustion engine by the fuel supply means; purge means (fuel vapor processing device 40 in the embodiment) for purging fuel vapor, produced in the fuel tank, into an intake system of the internal combustion engine; idle determination means (determination in step S401 by the ECU 5 in the embodiment) for determining whether the internal combustion engine is in an idle state or not; update amount setting means (processes of steps S409, S414, S420, S422, S423, S427, S429, S432, S434 and S435 performed by the ECU 5 in the embodiment) for setting a update amount smaller/lower?? when the internal combustion engine is in the idle state than when the internal combustion engine is not in the idle state; and purge-correction-amount updating means (processes of steps S023 and S025 performed by the ECU 5 in the embodiment) for updating a purge correction amount (purge correction coefficient KAFEVACT in the embodiment) for correcting the amount of fuel (fuel injection time TOUT in the embodiment) with the update amount set by the update amount setting means.

As apparent from the above, when the idle determination means has determined that the internal combustion engine is in an idle state, the update amount setting means sets a update amount so as to be smaller when the internal combustion engine is in the idle state than when the internal combustion engine is not in the idle state, and the purge-correction-amount updating means updates the purge correction amount with that update amount. As the update amount is made smaller when the internal combustion engine is in the idle state, the running of the engine will not become unstable. As the update amount is made larger when the internal combustion engine is in states other than the idle state, the correction can properly respond to the influence of purging so that the exhaust component characteristic will not deteriorate.

It is therefore another object of the present invention to provide the apparatus which can appropriately determines the amount of fuel to be supplied, depending on the driving condition and the target air-fuel ratio.

To achieve the above object, the control apparatus for an internal combustion engine of the present invention comprises: a purge device (the passage 42, the purge passage 43, the purge control valve 44, the canister 45, the two-way valve 46 in the embodiment) for purging fuel vapor, produced in a fuel tank (the fuel tank 41 in the embodiment), into an intake system of the internal combustion engine (the engine body 1 in the embodiment); a purge correction amount calculator (steps S003, and S039 to S043 executed by the ECU 5 in the embodiment) for calculating the purge correction amount for decreasing the amount of fuel to be supplied to the internal combustion engine, depending on the amount purged by the purge device; a target air-fuel ratio setting device (the ECU 5 in the embodiment) for setting a target air-fuel ratio in accordance with the running state of the internal combustion engine; an air-fuel ratio correction amount calculator (the ECU 5 in the embodiment) for calculating an air-fuel ratio correction amount for adjusting the air-fuel ratio of mixture to be supplied to the internal combustion engine to the target air-fuel ratio set by the target air-fuel ratio setting device; an update amount setting device (steps S053 to S065 executed by the ECU 5) for setting the update amount of the purge correction amount, depending on the target air-fuel ratio set by the target air-fuel ratio setting device; and a fuel supply amount determining device (the ECU 5) for determining the amount of fuel to be supplied to the internal combustion engine, depending on the purge correction amount, updated based on the update amount determined by the update amount setting device, and on the air-fuel ratio correction amount.

With the above structure, the update amount calculator determines the update amount of the purge correction amount, depending on the target air-fuel ratio set by the target air-fuel ratio setting device. When the actual air-fuel ratio is leaner than the target air-fuel ratio, the update amount of the purge correction amount is changed/updated/corrected/???? gradually, thereby preventing a decrease in the engine speed and the engine stop due to the over-lean state.

In another aspect of the present invention, the purge correction amount calculator gradually decreases the correction amount when stopping the purging.

With the above structure, when executing the purge cutting, the decreasing correction value for decreasing the amount of fuel to be supplied to the internal combustion engine is not immediately set to 0, and gradually becomes 0], thereby preventing the rich-state of the actual air-fuel ratio due to the fuel vapor remaining in the system.

BRIEF DESCRIPTION OF THE DRAWINGS

FIG. 3 is a subroutine flowchart illustrating procedures for computing a purge concentration coefficient KAFEV which are executed in step S007 in FIG. 2;

DETAILED DESCRIPTION OF THE PREFERRED EMBODIMENT

A preferred embodiment of the present invention will now be described with reference to the accompanying drawings.

Figure 1:
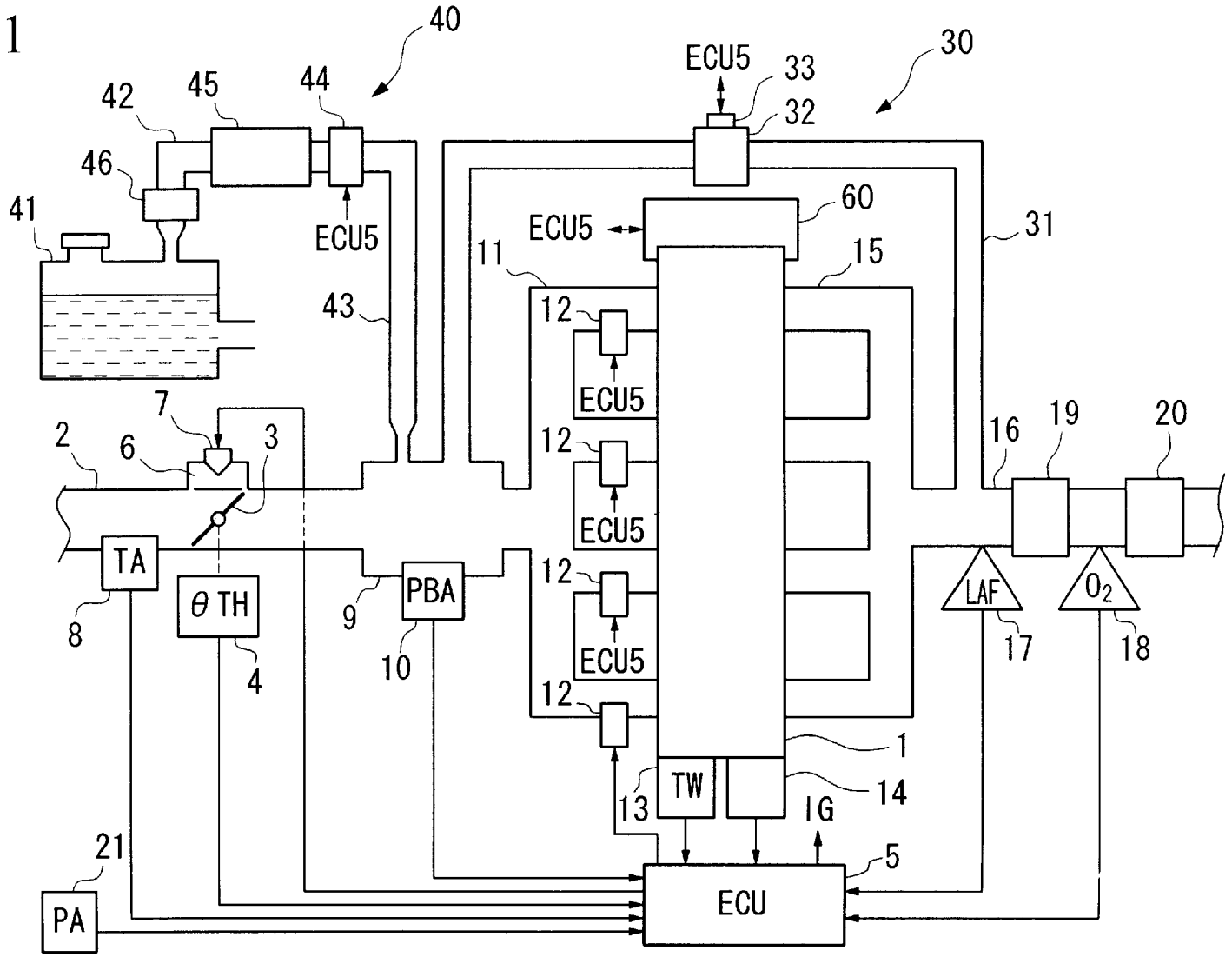
FIG. 1 is a block diagram illustrating one embodiment of the present invention.

FIG. 1 is a block diagram illustrating one embodiment of this invention. In FIG. 1, reference numeral "1" denotes a four-cylinder in-line internal combustion engine body (hereinafter referred to as "engine body") which generates power. The engine body 1 has an intake valve and exhaust valve (neither shown) provided in each cylinder.

The internal combustion engine has intake tubes 2 which connect to the combustion chambers in the individual cylinders of the engine body 1 via a branched portion (intake manifold) 11. A throttle valve 3 is disposed in the intake tube 2. A throttle position sensor 4, which senses the degree of throttle opening (e.g., the extent of the throttle opening) θTH, is connected to the throttle valve 3. The throttle position sensor 4 outputs an electric signal corresponding to the degree of throttle opening θTH and sends it to an ECU (Electronic Control Unit) 5. The intake tube 2 is provided with an auxiliary air passage 6 which bypasses the throttle valve 3. An auxiliary air flow rate control valve 7 is placed in the passage 6. The degree of opening of the auxiliary air flow rate control valve 7, which is connected to the ECU 5, is controlled by the ECU 5.

An intake-temperature sensor (TA) 8 is connected to the upstream side of the throttle valve 3 in the intake tube 2. The detection signal from the intake-temperature sensor 8 is supplied to the ECU 5. A chamber 9 is provided between the throttle valve 3 in the intake tube 2 and the intake manifold 11. An intake-tube absolute pressure (PBA) sensor 10 is connected to the chamber 9. The detection signal from the PBA sensor 10 is supplied to the ECU 5.

An internal combustion engine water temperature (TW) sensor 13 is attached to the engine body 1 and its detection signal is supplied to the ECU 5. Also connected to the ECU 5 is a crank angle sensor 14 which detects the rotational angle of the crankshaft (not shown) of the engine body 1. The crank angle sensor 14 sends a signal corresponding to the rotational angle of the crankshaft to the ECU 5. The crank angle sensor 14 comprises a cylinder identification sensor, a TDC (Top Dead Center) sensor, and a CRK sensor. The cylinder identification sensor outputs a signal pulse at a predetermined crank angle position of a specific cylinder of the engine body 1 (hereinafter called "CYL signal pulse). The TDC sensor outputs a TDC signal pulse at a crank angle position (every crank angle of 180 degrees in the four-cylinder engine) before the predetermined crank angle position with regard to the top dead center at the beginning of the intake stroke of each cylinder. The CRK sensor outputs a single pulse at a given crank angle period (e.g., a period of 30 degrees) shorter than the period of the TDC signal pulse (hereinafter called "CRK signal pulse). The CYL signal pulse, TDC signal pulse and CRK signal pulse are supplied to the ECU 5. Those signal pulses are used to control various kinds of timings, such as fuel injection timing and ignition timing, and to detect the engine speed NE of the internal combustion engine.

A fuel injection valve 12 is provided for each cylinder at a position slightly upstream of the associated intake valve of the intake manifold 11. Each fuel injection valve 12 is connected to an unillustrated fuel pump and is electrically connected to the ECU 5. The fuel injection timing and fuel injection time (valve open time) of the fuel injection valve 12 are controlled by signals from the ECU 5. Ignition plugs (not shown) of the engine body 1 are also electrically connected to the ECU 5, so that an ignition timing θIG is controlled by the ECU 5.

Exhaust tubes 16 connect to the combustion chambers of the engine body 1 via a branched portion (exhaust manifold) 15. The exhaust tube 16 of the exhaust system is provided with a large air-fuel sensor (hereinafter called "LAF sensor") 17 directly downstream from the location of the exhaust manifold 15. Provided downstream from the LAF sensor 17 are a directly-underlying[under the engine] three-way catalytic converter 19 and an under-floor[under the carriage] three-way catalytic converter 20 between which an oxygen concentration sensor (hereinafter called "O2 sensor") 18. The three-way catalytic converters 19 and 20 purify emissions, such as HC, CO and NOx, in the exhaust gas.

The LAF sensor 17, connected to the ECU 5, detects the oxygen concentration in the exhaust gas or the real air-fuel ratio, outputs an electric signal proportional to the real air-fuel ratio and sends the electric signal to the ECU 5. One characteristic of the O2 sensor is that its output drastically changes around the stoichiometric air-fuel ratio. The output of the O2 sensor 18 becomes a high level on the richer side than the stoichiometric air-fuel ratio and becomes a low level on the leaner side than the stoichiometric air-fuel ratio. The O2 sensor 18 is connected to the ECU 5 so that its detection signal is supplied to the ECU 5.

An exhaust gas recirculation (EGR) mechanism 30 comprises an EGR passage 31, an EGR valve 32 and a lift sensor 33. The EGR passage 31 connects the chamber 9 of the intake tube 2 to the associated exhaust tube 16. The EGR valve 32, which is disposed in the EGR passage 31, regulates the recirculation rate of the exhaust gas. The lift sensor 33 detects the degree of opening of the EGR valve 32 and sends its detection signal to the ECU 5. The EGR valve 32 is an electromagnetic valve having a solenoid connected to the ECU 5. The EGR valve 32 is constructed in such a way that the degree of its opening can be changed linearly by a control signal from the ECU 5.

A fuel vapor processing device 40 purges the fuel vapor produced in a fuel tank 41, which retains the fuel, into the intake system of the engine body 1. The fuel tank 41 is connected via a passage 42 to a canister 45, which is connected to the chambers 9 of the intake tubes 2, via a purge passage 43. The canister 45 incorporates an adsorbent which adsorbs the fuel vapor produced in the fuel tank 41, and has an air inlet port. A two-way valve 46, comprised of a positive pressure valve and a negative pressure valve, is disposed in the passage 42. A purge control valve 44, which is a duty-control type electromagnetic valve, is provided in the purge passage 43. The purge control valve 44 is connected to the ECU 5 and is controlled in accordance with a signal from the ECU 5.

The ECU 5 has an input circuit, a central processing unit (CPU), a memory circuit, and an output circuit. The input circuit has functions such as shaping the waveforms of input signals from the aforementioned various sensors to correct the voltage levels to predetermined levels and changing an analog signal value to a digital signal value. The memory circuit comprises a ROM and RAM, which store various operational programs to be run by the CPU and various maps and operational results or the like, which will be discussed below. The output circuit sends drive signals to various electromagnetic valves, such as the fuel injection valves 12 and the purge control valve 44, and the ignition plugs.

The ECU 5 discriminates various running states of the internal combustion engine, such as the feedback control operation area and open control operation area according to the outputs of the LAF sensor 17 and O2 sensor 18, based on the aforementioned various engine operation parameter signals. The ECU 5 computes a fuel injection time TOUT of each fuel injection valve 12 in accordance with the running state of the internal combustion engine and outputs a signal for driving that fuel injection valve 12 based on the computation result. That is, the ECU 5 controls the internal combustion engine which has the engine body 1, the fuel injection valves 12, the fuel tank 41 and the fuel vapor processing device 40. In accordance with the amount of the fuel vapor that is purged by the fuel vapor processing device 40, the ECU 5 corrects the fuel injection time TOUT of each fuel injection valve 12 or the amount of fuel to be supplied to the engine body 1 by that fuel injection valve 12.

The fuel injection time TOUT of the fuel injection valve 12 equivalent to the amount of fuel (the valve open time of the fuel injection valve 12) is acquired approximately from the following equation.

$$TOUT = KTTL \times TIM \times KAF \times KCMD - KAFEVACT \times TIM \times KCMD$$

where KTTL is a correction coefficient other than the air-fuel ratio correction coefficient, TIM is a basic fuel injection amount, which is a map value determined by the negative pressure of the intake system of the internal combustion engine and the engine speed NE, KAF is an air-fuel-ratio feedback coefficient, which is a feedback coefficient for PID control of the air-fuel ratio according to the output of the LAF sensor 17, and KCMD is a target air-fuel ratio coefficient based on a target air-fuel ratio and KAFEVACT is a purge correction coefficient.

As apparent from this equation, the valve open time TOUT of the fuel injection valve 12 is obtained by subtracting a value based on the purge correction coefficient KAFEVACT, which reflects the purge-oriented influence, from a value based on the basic fuel injection amount TIM, which is determined from the running state of the internal combustion engine, the target air-fuel ratio coefficient KCMD, the air-fuel-ratio feedback coefficient KAF, etc. That is, the purge correction coefficient KAFEVACT is the correction amount for correcting the fuel injection time TOUT in such a way as to eliminate the purge-oriented influence.

A routine (KAFEVACT_CAL) of computing this purge correction coefficient KAFEVACT will be discussed below referring to the subroutine flowchart shown in FIG. 2. One cycle of the KAFEVACT_CAL flowchart from the start to the end is executed every time, for example, the TDC sensor outputs the TDC signal pulse.

This subroutine has a step of separately setting the purge correction coefficient KAFEVACT between during purging and during purge cutting.

First, in step S001, it is determined whether the value of a feedback control execution flag F_LAFFB is set to "1" or not, i.e., whether the air-fuel-ratio feedback control is being performed or not. When the air-fuel-ratio feedback control is underway (the determination is YES), the flow proceeds to step S003. When the air-fuel-ratio feedback control is not underway (the determination is NO), the flow proceeds to step S031.

In step S003, it is determined whether a purge-control-valve actuation duty value DOUTPG is "0%" or not, i.e., whether an instruction value for the purge control valve 44 is "0" or not. When the purge control valve 44 is open (the determination is NO) or while purging is taking place, the flow proceeds to step S005. When the purge control valve 44 is closed (the determination is YES) or while purge cutting is taking place, the flow proceeds to step S031.

[During Purging]

In step S005, a leaned (empirical) value for the air-fuel-ratio feedback coefficient KAF (hereinafter simply referred to as "air-fuel-ratio learned value") KREF/KREFX is selected. Specifically, the air-fuel-ratio learned value KREF/KREFX is set to a value which has been selected based on the running state of the engine body 1 (four conditions of idle, lean burn, stoichiometric state, and rich burn). The air-fuel-ratio learned value KREF is the learned value that has been calculated and stored during purging, and the air-fuel-ratio learned value KREFX is the learned value that has been calculated and stored during purge cutting.

In step S007, the purge concentration coefficient KAFEV based on the air-fuel-ratio learned value KREF/KREFX or the like is computed. The procedures of computing the purge concentration coefficient KAFEV, which are illustrated in a subroutine flowchart (KAFEV_CAL) in FIG. 3, will be discussed below.

In step S009, it is determined whether or not the absolute value of a deviation DKCMD between a current target air-fuel ratio coefficient KCMDn and a last target air-fuel ratio coefficient KCMDn−1 is equal to or above a predetermined threshold value #DKCMEVA. When the determination is YES, i.e., when the target air-fuel ratio (A/F) is changing, the flow proceeds to step S011. When the determination is NO, i.e., when the target air-fuel ratio (A/F) is not changing, the flow proceeds to step S013.

In step S011, a predetermined timer value #TMDKCEVA (e.g., 1.5 sec) is set to a target-air-fuel-ratio changing delay timer TDKCEVA, then the timer is started. Accordingly, the subsequent processing will not be executed while the target air-fuel ratio (A/F) is changing or while a calculation error for the purge concentration coefficient KAFEV or the like is expected to become larger.

In step S013, it is determined whether the timer value of the target-air-fuel-ratio changing delay timer TDKCEVA is "0 sec". When the determination is NO, the subsequent processing will not take place as described above. When the determination is YES, the flow proceeds to step S015.

In step S015, a target purge correction coefficient KAFEVACZ is computed. The procedures of computing the target purge correction coefficient KAFEVACZ, which are illustrated in a subroutine flowchart (KAFEVACZ_CAL) in FIG. 4, will be discussed below.

Shortly after purging is performed, i.e., while the purge control valve 44 is opened and the fuel vapor reaches the intake manifold 11, the influence of the fuel vapor on the air-fuel ratio (A/F) is delayed. Steps S017, S019, S021, S027 and S029 are executed to stop the calculation of the purge correction coefficient KAFEVACT during such a period.

Figure 5:
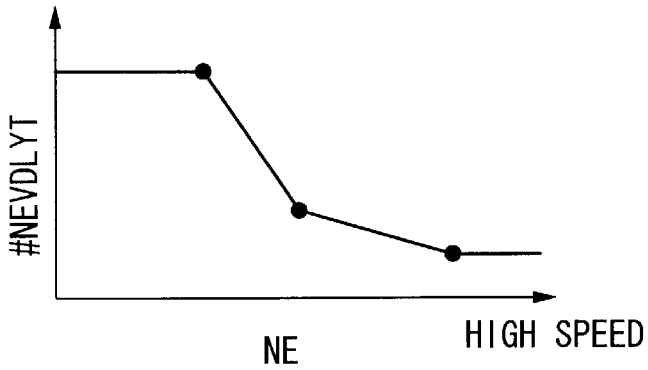
FIG. 5 is a diagram for looking up a temporary variable NEVDLYT from an engine speed NE in a table.

In step S017, a temporary variable NEVDLYTX is set to a predetermined value #NEVDLYT of a purge-correction-coefficient addition delay. The predetermined value #NEVDLYT is acquired by looking up an NEVDLYT table in FIG. 5 in accordance with the engine speed NE. As illustrated in the diagram, the temporary variable NEVDLYTX is set so as to become smaller as the engine speed NE becomes higher.

In step S019, it is determined whether or not the value of a counter NEVDLY is equal to or above the purge-correction-coefficient addition delay NEVDLYTX set in step S017. When the determination is YES, it is judged that the aforementioned influence delay has been cleared and the flow proceeds to step S021. When the determination is NO, it is judged that the aforementioned influence delay has not been cleared and the flow proceeds to step S027.

In step S021, the value of a flag F_NEVDLYED is set to "1", which indicates that the delay has been cleared. This allows the flow to return to the routine of computing a purge-correction-coefficient computation correction coefficient KEVACT or the like depending on the result of the determination in step S027, even when the determination is NO in step S019.

In step S027, it is determined whether the value of the flag F_NEVDLYED is set to "1" or not. When the determination is YES, the flow proceeds to step S023. When the determination is NO, the flow proceeds to step S029.

In step S029, the value of the counter NEDVDLY is incremented.

In step S023, the purge-correction-coefficient computation correction coefficient KEVACT is computed. The procedures of computing the purge-correction-coefficient computation correction coefficient KEVACT, which are illustrated in a subroutine flowchart (KEVACT_CAL) in FIGS. 15 and 16, will be discussed below.

In step S025, the purge correction coefficient KAFEVACT is a value obtained by multiplying the target purge correction coefficient KAFEVACZ that has been calculated in step S015 by purge-correction-coefficient computation correction coefficient KEVACT that has been calculated in step S023.

[During Purge Cutting]

When the air-fuel-ratio feedback control is not underway (the determination is NO in step S001), or when purge cutting is in progress (the determination is YES in step S003) even when the air-fuel-ratio feedback control is underway (the determination is YES in step S001), the flow proceeds to step S031.

In step S031 and subsequent steps S033, S035 and S037, the individual flag values of the flag F_NEVDLYED, the counter NEDVDLY, the purge-correction-coefficient computation correction coefficient KEVACT and the target purge correction coefficient KAFEVACZ are set to "0".

In step S039, when the purge correction coefficient decreases, a predetermined subtraction amount #DKAFEVAM (e.g., 0.023) is subtracted from the purge correction coefficient KAFEVACT and the new purge correction coefficient KAFEVACT is set to the resultant value. Even when the purge control valve 44 is fully closed (the determination is YES in step S003), therefore, the purge correction coefficient KAFEVACT is not set to "0" instantaneously, but can be made to gradually approach "0" using this subtraction amount #DKAFEVAM. This can effectively suppress or prevent the transition of the real air-fuel ratio to the rich state that is caused by the influence of the fuel vapor remaining in the system even after purge cutting.

In step S041, it is determined whether the purge correction coefficient KAFEVACT after subtraction (step S011) is smaller than the target purge correction coefficient KAFEVACZ. When the coefficient KAFEVACT is below the coefficient KAFEVACZ (the determination is YES), the flow proceeds to step S043. When the coefficient KAFEVACT is not below the coefficient KAFEVACZ (the determination is NO), the step S043 will be skipped.

In step S043, the purge correction coefficient KAFEVACT is set to "0".

Referring now to the subroutine flowchart of FIG. 3, a description will now be given of the procedures of calculating the purge concentration coefficient KAFEV, which are executed in step S007 in FIG. 2.

This subroutine has a step of separately setting an addition/subtraction term DKEVAPO of the purge concentration coefficient KAFEV between idling and driving, a step of setting the addition/subtraction term DKEVAPO during driving in accordance with the target air-fuel ratio coefficient KCMD, and a step of preventing erroneous learning of the purge concentration coefficient KAFEV while the target air-fuel ratio coefficient KCMD is changing.

First, in step S051, it is determined whether the value of the last feedback control execution flag F_LAFFB is set to "1" or not, i.e., whether the air-fuel-ratio feedback control has been carried out or not. When the air-fuel-ratio feedback control has not been performed (the determination is NO), the routine is terminated then. When the air-fuel-ratio feedback control has been performed (the determination is YES), the flow proceeds to step S053.

In step S053, it is determined whether the value of an idle flag F_IDLE is set to "1" or not, i.e., whether the engine body 1 is idling or not. When the engine body 1 is idling (the determination is YES), the flow proceeds to step S055. When the engine body 1 is not idling (the determination is NO), the flow proceeds to step S057.

In step S055, the addition/subtraction term DKEVAPO is set to a predetermined value #DKEVAPO1 (e.g., 0.001). #DKEVAPO1 is an addition/subtraction term in an idle state.

In step S057, it is determined whether a vehicle speed VP is "0" or not, i.e., whether the vehicle is stopped. When the vehicle is stopped (the determination is YES), the flow proceeds to step S055. When the vehicle is running (the determination is NO), the flow proceeds to step S059.

Figure 7:
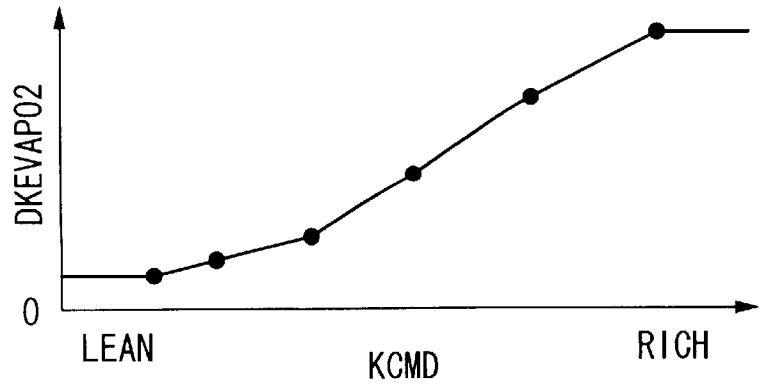
FIG. 7 is a diagram for looking up an addition/subtraction term DKEVAPO2 from a target air-fuel ratio coefficient KCMD in a table.

In step S059, an addition/subtraction term #DKEVAPO2 according to the target air-fuel ratio coefficient KCMD is looked up in a table (FIG. 7). #DKEVAPO2 is an addition/subtraction term in other states than the idle state, and, as shown in FIG. 7, is set so as to become smaller as the target air-fuel ratio coefficient KCMD gets smaller. This can make variations in the purge concentration coefficient KAFEV gentler during lean bum (the determination is YES) where combustion becomes unstable, thus preventing the drivability from being deteriorated due to the fuel becoming too lean].

In step S061, the addition/subtraction term DKEVAPO is set to the predetermined value #DKEVAPO2 (e.g., 0.07) that has been acquired in the table search in step S059.

The above-described steps S053 to S061 accomplish the process of separately setting the addition/subtraction term DKEVAPO of the purge concentration coefficient KAFEV between idling and driving and the process of setting the addition/subtraction term DKEVAPO in accordance with the target air-fuel ratio coefficient KCMD even during driving.

In step S063, it is determined whether or not the absolute value of the deviation DKCMD between the current value KCMDn and the last value KCMDn−1 of the target air-fuel ratio coefficient is equal to or above a predetermined threshold value #DKCMEV (e.g., 0.008). When the determination is YES or when it is determined that the target air-fuel ratio coefficient KCMD is changing, the flow proceeds to step S065. Otherwise (the determination is NO), the flow proceeds to step S067.

In step S065, a delay timer TDKCMEV for computing the purge concentration coefficient is set to a predetermined timer value #TMDKCMEV (e.g., 1.5 sec) after the transition of the target air-fuel ratio is completed, and the delay timer TDKCMEV is then started. As a result, the purge concentration coefficient KAFEV is not computed for the predetermined timer period since the completion of the transition of the target air-fuel ratio. This effectively prevents erroneous learning of the purge concentration coefficient KAFEV that may occur while the target air-fuel ratio coefficient KCMD is changing.

In step S067, it is determined whether the value in the delay timer TDKCMEV is "0 sec". When the determination is NO, the process is interrupted as in the above case. When the determination is YES, the flow proceeds to step S069.

Figure 6:
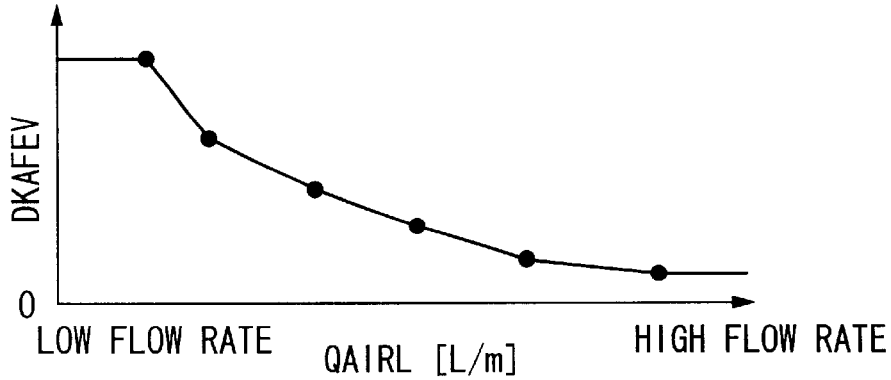
FIG. 6 is a diagram for looking up a purge-concentration-coefficient computation determination deviation DKAFEV from an air flow rate QAIR in a table.

In step S069, a purge-concentration-coefficient computation determination deviation DKAFEV corresponding to an air flow rate QAIR is looked up in a table (FIG. 6), and is set to a predetermined value #DKAFEV (e.g., 0.07) obtained by the table search. The purge-concentration-coefficient computation determination deviation DKAFEV is set so as to become smaller as the air flow rate QAIR becomes greater, as illustrated in FIG. 6.

Figure 2:
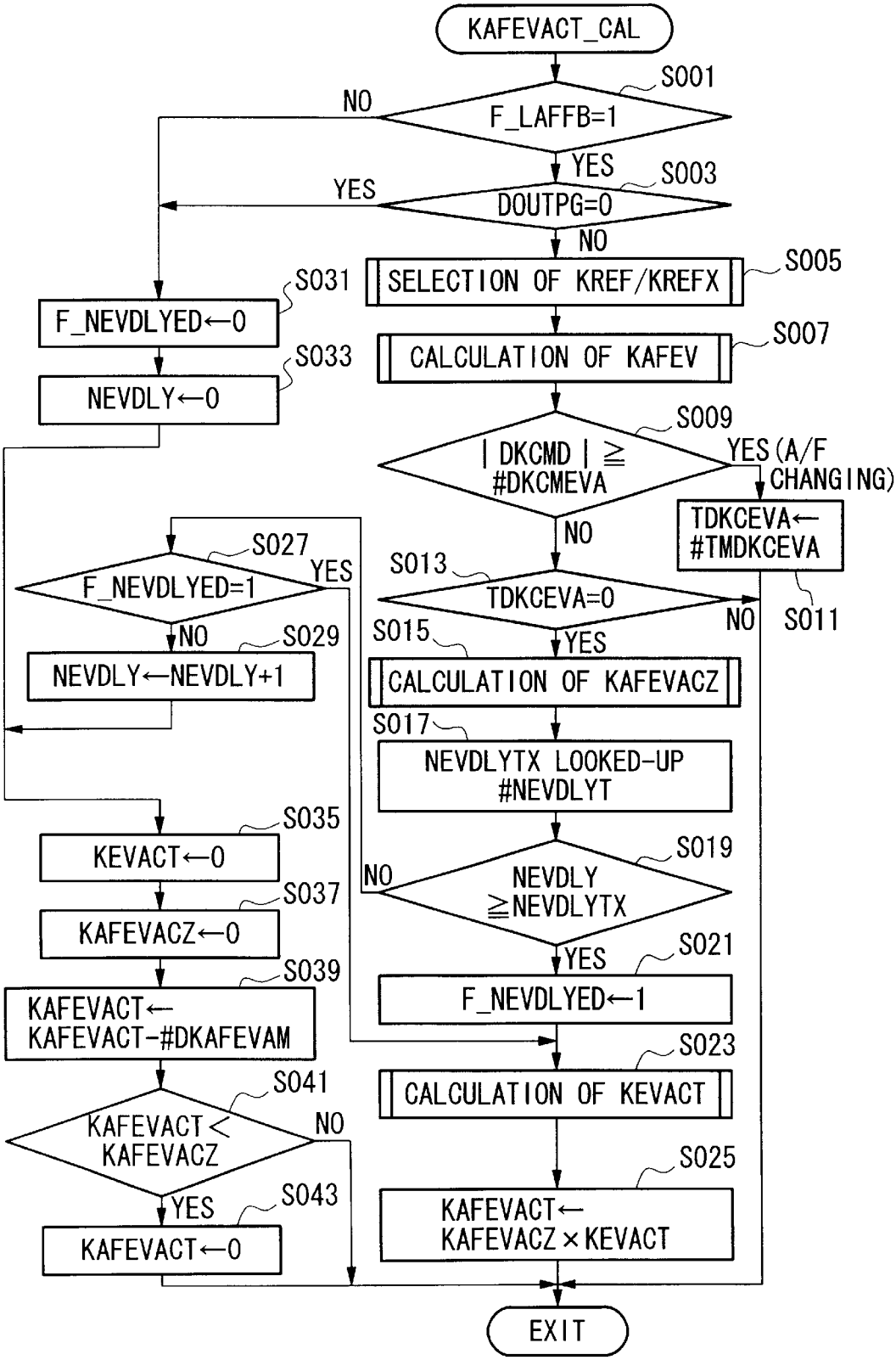
FIG. 2 is a subroutine flowchart illustrating procedures for computing a purge correction coefficient KAFEVACT.

In steps S071 and S073, it is determined whether the air-fuel-ratio feedback coefficient KAF, which is obtained by a known method, such as PID control rules, based on the value detected by the LAF sensor 17, is smaller than a lower threshold value obtained by subtracting the purge-concentration-coefficient computation determination deviation DKAFEV from the air-fuel-ratio learned value KREFX selected in step S005 in FIG. 2 (the determination is YES in step S071), or is greater than an upper threshold value obtained by adding the purge-concentration-coefficient computation determination deviation DKAFEV to the air-fuel-ratio learned value KREFX (the determination is NO in step S071 and the determination is YES in step S073), or lies between the lower and upper threshold values (the determination is NO in both steps S071 and S073).

When the air-fuel-ratio feedback coefficient KAF is smaller than the lower threshold value (the determination is YES in step S071) and when the real air-fuel ratio coefficient KACT detected by the LAF sensor 17 is larger than the target air-fuel ratio coefficient KCMD (the determination is YES in step S075), it is judged that the air-fuel ratio (A/F) has become rich due to the influence of purging and the flow proceeds to step S079. When the determination is NO in step S075, however, the flow proceeds to step S083.

When the air-fuel-ratio feedback coefficient KAF is greater than the upper threshold value (the determination is NO in step S071 and the determination is YES in step S073) and when the real air-fuel ratio coefficient KACT is smaller than the target air-fuel ratio coefficient KCMD (the determination is YES in step S077), it is judged that there is no influence of purging and the flow proceeds to step S081. When the determination is NO in step S077, however, the flow proceeds to step S083.

When the air-fuel-ratio feedback coefficient KAF lies between the upper and lower threshold values (the determination is NO in both steps S071 and S073), the flow proceeds to step S083.

In step S079, a new temporary variable KAFEVF is set to the value that is acquired by adding the addition/subtraction term DKEVAPO set in step S055 or S061 to a temporary variable KAFEVF. This increases the purge concentration coefficient KAFEV that is computed in step S085.

In step S081, a new temporary variable KAFEVF is set to the value that is acquired by subtracting the addition/subtraction term DKEVAPO from the temporary variable KAFEVF. This decreases the purge concentration coefficient KAFEV that is computed in step S085.

In step S083, the value that is acquired by subtracting the air-fuel-ratio feedback coefficient KAF from the air-fuel-ratio learned value KREFX, dividing the resultant value by a coefficient #CAFEV (e.g., 256) and then adding the resultant value to the temporary variable KAFEVF, which is then serves as the new temporary variable KAFEVF. This can make the purge concentration coefficient KAFEV to be computed in step S085 either smaller or larger.

In the above-described steps S071 and S073, the air-fuel-ratio learned value KREFX is used as a reference parameter in computing the purge concentration coefficient KAFEV, so that the transition of the air-fuel ratio to the rich state or the lean state which is caused by the influence of the fuel vapor can be corrected adequately.

In step S085, grading computation is performed using the current temporary variable KAFEVF, the last temporary variable KAFEVF(n−1), and a grading value #CKAFEV (e.g., 0.031), and the purge concentration coefficient KAFEV is set to the computation result.

In step S087, it is determined whether the purge concentration coefficient KAFEV calculated in step S085 is equal to or above a predetermined limit value #KAFEVLMT (e.g., 2.0). When the coefficient KAFEV exceeds the predetermined limit value #KAFEVLMT (the determination is YES), the flow proceeds to step S089. When the coefficient KAFEV does not exceed the predetermined limit value #KAFEVLMT (the determination is NO), step S089 will be skipped.

In step S089, the purge concentration coefficient KAFEV is set to the limit value #KAFEVLMT.

Figure 4:
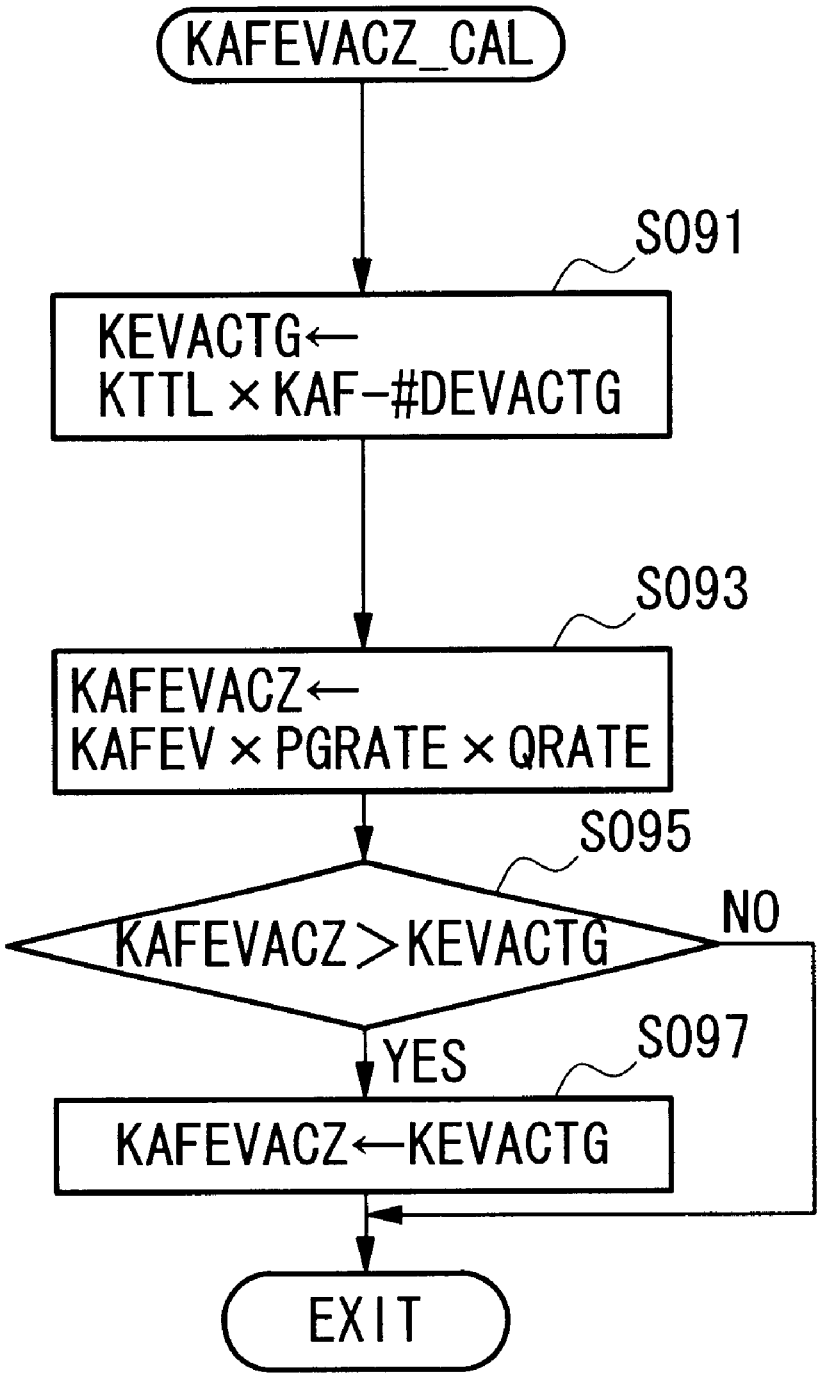
FIG. 4 is a subroutine flowchart illustrating procedures for computing a target purge correction coefficient KAFEVACZ, which are executed in step S015 in FIG. 2.

Referring now to the subroutine flowchart of FIG. 4, a description will be given of the procedures of calculating the target purge correction coefficient KAFEVACZ that are executed in step S015 in FIG. 2.

First, in step S091, a temporary variable KEVACTG is set to a value which is acquired by multiplying the other correction coefficient KTTL by the air-fuel-ratio feedback coefficient KAF and subtracting a predetermined guard computation correction value #DEVACTG.

In step S093, the target purge correction coefficient KAFEVACZ is set to a value which is acquired by multiplying the purge concentration coefficient KAFEV calculated in step S023, a purge-control-valve duty ratio PGRATE, and a target purge flow rate ratio QRATE together.

In step S095, it is determined whether the target purge correction coefficient KAFEVACZ set in step S093 is greater than the temporary variable KEVACTG set in step S091. When the determination is YES, the flow proceeds to step S097. When the determination is NO, step S097 will be skipped.

In step S097, the target purge correction coefficient KAFEVACZ is set to the temporary variable KEVACTG.

Figure 15:
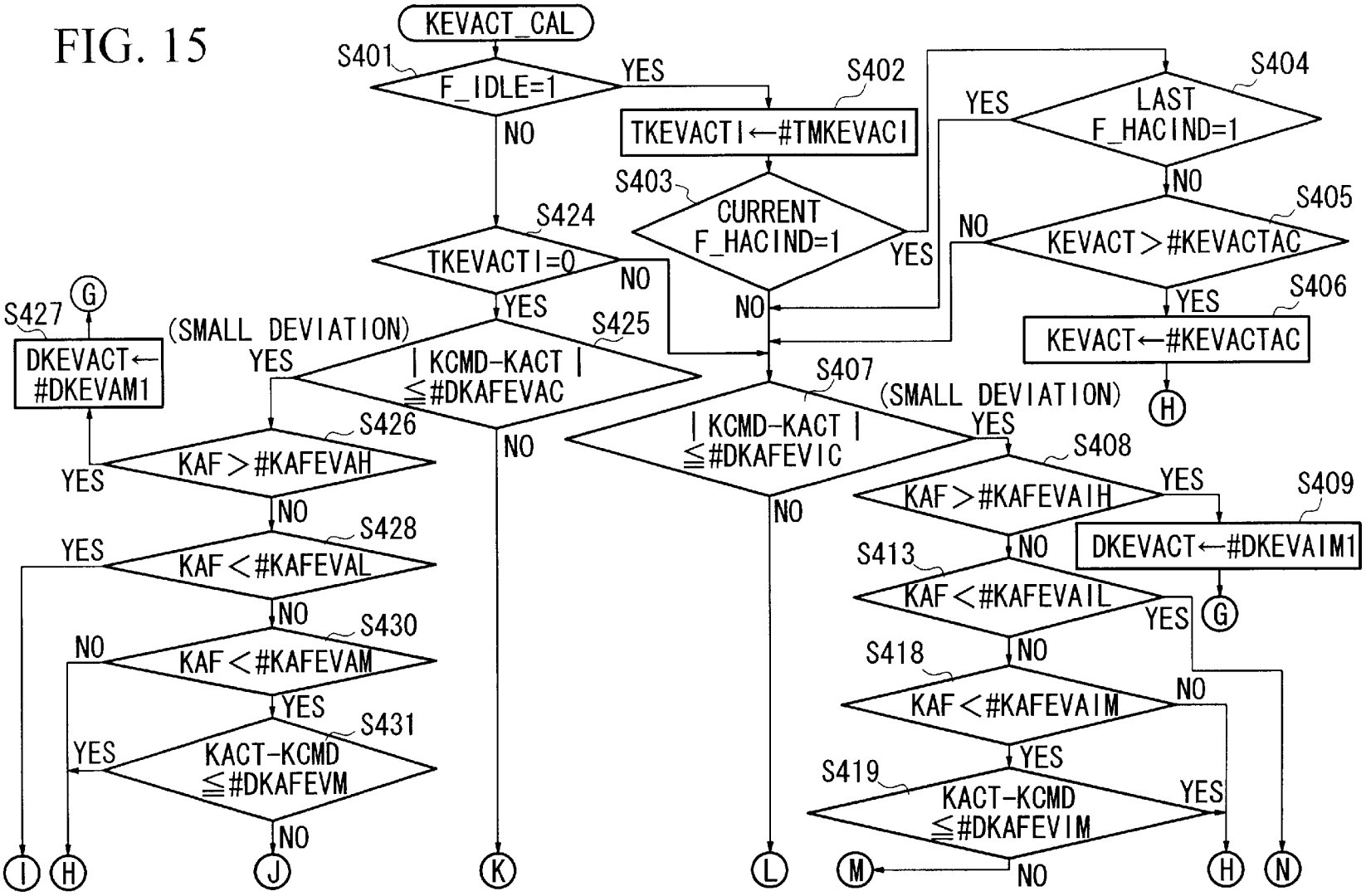
FIG. 15 is a flowchart illustrating a part of a routine of computing a purge-correction-coefficient computation correction coefficient KEVACT, which is the correction amount for correcting the purge correction coefficient KAFEVACT.
Figure 16:
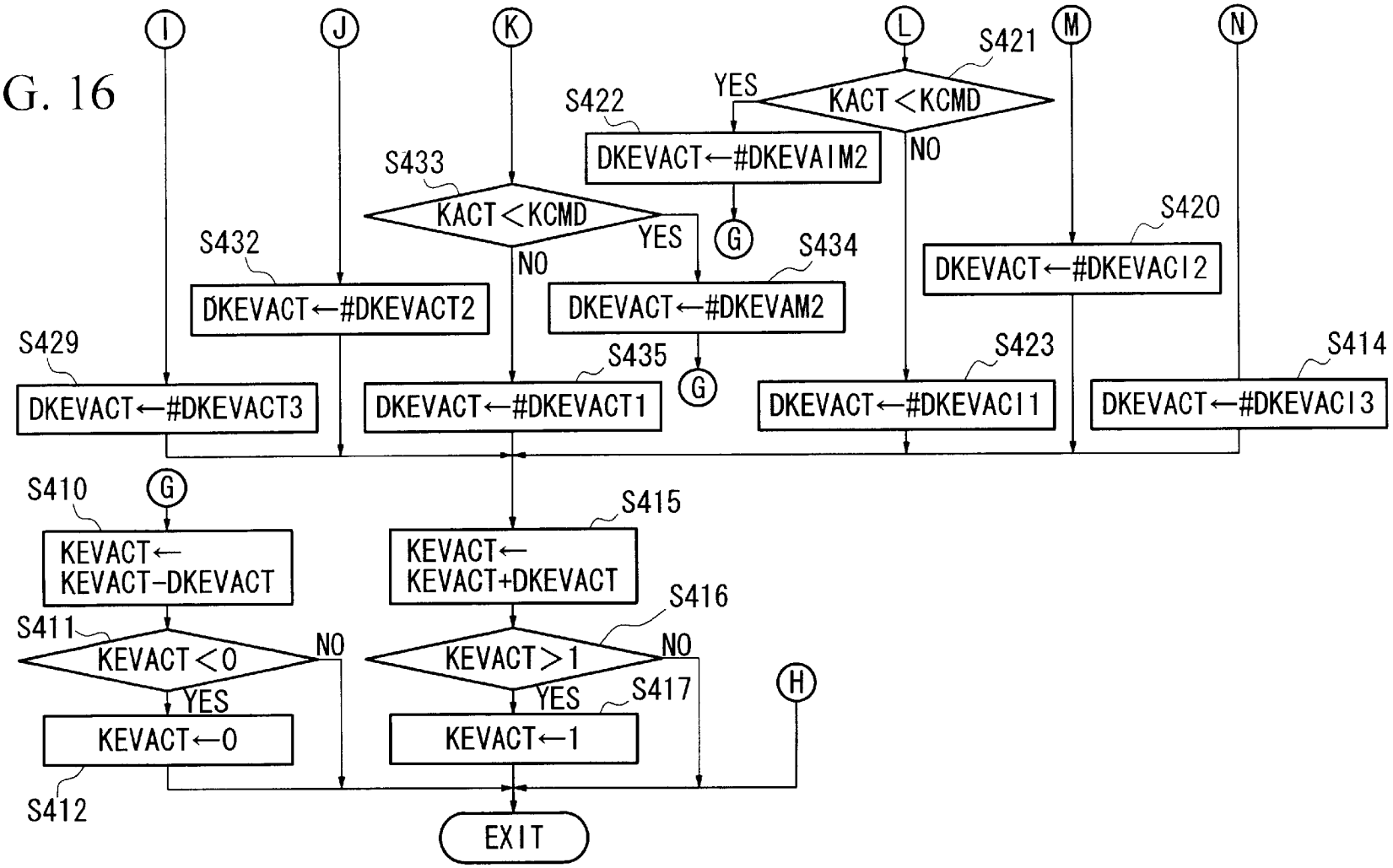
FIG. 16 is a flowchart illustrating the other part of the routine for computing the purge-correction-coefficient computation correction coefficient KEVACT or the correction amount for correcting the purge correction coefficient KAFEVACT.

Referring now to FIGS. 15 and 16, a subroutine flowchart for a routine (KEVACT_CAL) of computing the purge-correction-coefficient computation correction coefficient KEVACT (equal to or above 0 and equal to or below 1), which is a correction amount for correcting the purge correction coefficient KAFEVACT that is computed in step S023 in the flowchart of FIG. 1.

First, in step S401, it is determined whether or not the idle flag F_IDLE, which indicates if the engine body 1 is idling, is set, i.e., whether F_IDLE=1 or not.

When F_IDLE is not equal to 1 in the step S401 or when the engine body 1 is not idling, the flow proceeds to step S424, which will be discussed below.

[Idle State]

When F_IDLE=1 in step S401 or when the engine body 1 is idling, on the other hand, the value of a transition-to-non-idling-state delay timer TKEVACTI which is used in step S424 (to be described below) in determining whether or not a predetermined time has passed since the engine body 1 has come out of the idle state is set to a predetermined transition-to-non-idling-state delay timer value #TMKEVACI (e.g., 2.0 sec).

In the next step S403, it is determined whether air-conditioner ON flag F_HACIND, which indicates if the air-conditioner which is a load on the engine body 1, is ON is set in the present cycle of the computation routine (KEVACT_CAL) for the purge-correction-coefficient computation correction coefficient KEVACT, i.e., whether or not F_HACIND=1. The air-conditioner ON flag F_HACIND may be set by the air-conditioner load itself or the setting of this flag may be triggered when the secondary air for correcting the air-conditioner load is introduced.

When F_HACIND=1 is false in step S403, it is judged that the air-conditioner is not ON and the load of the engine body 1 is light, the flow proceeds to step S407.

When F_HACIND=1 is true in step S403, on the other hand, it is judged that the air-conditioner is ON and the load of the engine body 1 is large. In the next step S404, it is determined whether the air-conditioner ON flag F_HACIND had been set in the previous cycle in the computation routine (KEVACT_CAL) for the purge-correction-coefficient computation correction coefficient KEVACT or not, i.e., whether F_HACIND=1 was satisfied or not.

When, in step S404, F_HACIND=1 in the previous cycle, it is judged in step S406 that the ON state of the air-conditioner continues and no change in the load of the engine body 1 has been detected because F_HACIND=1 in the present cycle too. Then, the flow proceeds to step S407.

When F_HACIND=1 in the previous cycle is false in step S404, on the other hand, it is judged that the air-conditioner has just been changed to the ON state from the OFF state and a change in the load of the engine body 1 has been detected because F_HACIND has become equal to 1 in the present cycle in step S403. In step S405, it is determined whether the currently set purge-correction-coefficient computation correction coefficient KEVACT is greater than a predetermined limit value #KEVACTAC (specifically, 0.3) or not.

When KEVACT>#KEVACTAC is not true in step S405, the purge correction coefficient KAFEVACT based on the current purge-correction-coefficient computation correction coefficient KEVACT is small. It is thus judged that there will not be a large influence by a variation in load, if this has occurred, and the flow proceeds to step S407 to be discussed below.

When KEVACT>#KEVACTAC is true in step S405, on the other hand, it is judged that there will be a large influence by a variation in load. In the next step S406, the purge-correction-coefficient computation correction coefficient KEVACT is initialized to be the predetermined limit value #KEVACTAC, the current cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT. When the purge correction coefficient KAFEVACT for correcting the fuel injection time TOUT is large, such as in the case where fuel vapor with a high concentration occurs under a high temperature, an increase in the fuel vapor that enters through the purge control valve 44 is delayed immediately after the load changes. If the purge correction coefficient KAFEVACT is used directly, over-correction occurs, which results in the over-lean state, thus reducing the idling speed. The aforementioned initialization is executed to prevent such an inconvenience.

When it is judged in the step S403 that F_HACIND=1 in the current cycle is false, it is judged in step S404 that F_HACIND=1 in the previous cycle and it is judged in step S405 that KEVACT>#KEVACTAC is not satisfied, a difference or deviation |KCMD−KACT| between the real air-fuel ratio coefficient KACT based on the output of the LAF sensor 17 and the target air-fuel ratio coefficient KCMD is computed, and it is determined in step S407 whether the deviation is equal to or below a predetermined addition switching determination value #DKAFEVIC (specifically, 0.023) or not.

When |KCMD−KACT|≦#DKAFEVIC is false in step S407 or when the deviation |KCMD−KACT| is large, the flow proceeds to step S421 to be discussed below.

When |KCMD−KACT|≦#DKAFEVIC is true in step S407 or when the deviation |KCMD−KACT| is small, on the other hand, it is determined in step S408 whether the air-fuel-ratio feedback coefficient KAF is larger than a predetermined large subtraction determination value #KAFEVAIH (specifically, 1.063) or not.

When KAF>#KAFEVAIH is true in step S408 or when the air-fuel-ratio feedback coefficient KAF becomes greater than #KAFEVAIH (1.063), the purge-correction-coefficient computation correction coefficient KEVACT is reduced. In the next step S409, an update amount DKEVACT which reduces the purge correction coefficient KAFEVACT is set to a predetermined subtraction amount #DKEVAIM1 (specifically, 0.00005).

In step S410, the update amount DKEVACT is subtracted from the purge-correction-coefficient computation correction coefficient KEVACT and the new purge-correction-coefficient computation correction coefficient KEVACT is set to the resultant value. In the subsequent step S411, it is determined whether the newly set purge-correction-coefficient computation correction coefficient KEVACT is smaller than "0" or not. When KEVACT<0 is not satisfied, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KEVACT<0 in step S411, on the other hand, the purge-correction-coefficient computation correction coefficient KEVACT is set to "0" in step S412, the present cycle of the computation routine (KEVACT_CAL) for the purge-correction-coefficient computation correction coefficient KEVACT is terminated, and the flow returns to the flowchart of the computation routine (KAFEVACT_CAL) for the purge correction coefficient KAFEVACT.

When KAF>#KAFEVAIH is false in the step S408, it is determined in step S413 whether the air-fuel-ratio feedback coefficient KAF is smaller than a predetermined small addition switching determination value #KAFEVAIL (specifically, 0.953) or not.

When KAF<#KAFEVAIL in step S413 or when the air-fuel-ratio feedback coefficient KAF becomes smaller than #KAFEVAIL (specifically, 0.953), the purge-correction-coefficient computation correction coefficient KEVACT is increased. In the next step S414, the update amount DKEVACT is set to a predetermined addition amount #DKEVACI3 (specifically, 0.0005).

In step S415, the update amount DKEVACT is added to the purge-correction-coefficient computation correction coefficient KEVACT and a new purge-correction-coefficient computation correction coefficient KEVACT is set to the resultant value. In the subsequent step S416, it is determined whether the newly set purge-correction-coefficient computation correction coefficient KEVACT is larger than "1" or not. When KEVACT>1 is false, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KEVACT>1 in step S416, on the other hand, the purge-correction-coefficient computation correction coefficient KEVACT is set to "1" in step S417 and the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KAF<#KAFEVAIL is false in the step S413, it is determined in step S418 whether or not the air-fuel-ratio feedback coefficient KAF is smaller than a predetermined hold determination value #KAFEVAIM (specifically, 0.992), which is slightly greater than the addition switching determination value #KAFEVAIL.

When KAF<#KAFEVAIM is false in step S418, the present cycle of the computation routine (KEVACT_CAL) for the purge-correction-coefficient computation correction coefficient KEVACT is terminated without changing the purge-correction-coefficient computation correction coefficient KEVACT and the flow returns to the flowchart of the computation routine (KAFEVACT_CAL) for the purge correction coefficient KAFEVACT.

When KAF<#KAFEVAIM is true in step S418 or the air-fuel-ratio feedback coefficient KAF becomes smaller than #KAFEVAIM (specifically, 0.992), it is determined in step S419 whether or not a value acquired by subtracting the target air-fuel ratio coefficient KCMD from the real air-fuel ratio coefficient KACT is equal to or below a predetermined hold determination value #DKAFEVIM (specifically, 0.003). When KACT−KCMD≦#DKAFEVIM or when the air-fuel ratio is on the lean side, the present cycle of the computation routine (KEVACT_CAL) for the purge-correction-coefficient coefficient computation correction coefficient KEVACT is terminated and the flow returns to the flowchart of the computation routine (KAFEVACT_CAL) for the purge correction coefficient KAFEVACT.

When KACT−KCMD≦#DKAFEVIM is false in step S419 or when the air-fuel ratio is on the rich side, on the other hand, the update amount DKEVACT, which increases the purge correction coefficient KEVACT, is set to #DKEVACT2 in step S420. After the addition in the aforementioned steps S415–S417 is performed, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

That is, the process in the steps S408–S420 selects the update amount DKEVACT for the purge-correction-coefficient computation correction coefficient KEVACT for correcting the computation routine (KAFEVACT_CAL) for the purge correction coefficient KAFEVACT in accordance with the air-fuel-ratio feedback coefficient KAF, when the deviation |KCMD−KACT| is small. Specifically, when the air-fuel-ratio feedback coefficient KAF is larger than the subtraction determination value #KAFEVAIH (specifically, 1.063) and larger than a center value (specifically, 1.0), the subtraction amount #DKEVAIM1 (specifically, 0.0005) is selectively set as the update amount DKEVACT. When KAF lies in a range which is equal to or below the subtraction determination value #KAFEVAIH (specifically, 1.063) which is greater than the center value and is equal to or above the hold determination value #KAFEVAIM (specifically, 0.992) which is smaller than the center value, the purge-correction-coefficient computation correction coefficient KEVACT is not altered. When KAF lies in a range which is smaller than the hold determination value #KAFEVAIM (specifically, 0.992) which is below the former range and is equal to or above the addition switching determination value #KAFEVAIL (specifically, 0.953), a small addition amount #DKEVACI2 (specifically, 0.0001) is selectively set as the update amount DKEVACT when the deviation |KCMD−KACT| is large. With KAF lying in the latter range, when the deviation |KCMD−KACT| is smaller than the addition switching determination value #KAFEVAL (specifically, 0.953), which is significantly smaller than the center value (specifically, 1.0), the large addition amount #DKEVACI3 (specifically, 0.0005) is selectively set as the update amount DKEVACT.

When |KCMD−KACT|≦#DKAFEVIC is false in the step S407 or when the deviation |KCMD−KACT| is large, it is determined in step S421 whether or not the real air-fuel ratio coefficient KACT is smaller than the target air-fuel ratio coefficient KCMD, i.e., whether the real air-fuel ratio is leaner or richer than the target air-fuel ratio. When KACT<KCMD in step S421 or when the real air-fuel ratio is leaner than the target air-fuel ratio, the update amount DKEVACT for updating the purge-correction-coefficient computation correction coefficient KEVACT is set to a predetermined large subtraction amount #DKEVAIM2 (specifically, 0.0005) in step S422. Then, the subtraction in the steps S410–S412 is executed, after which the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KACT<KCMD is false in step S421 or when the real air-fuel ratio is richer than the target air-fuel ratio, on the other hand, the update amount DKEVACT for updating the purge-correction-coefficient computation correction coefficient KEVACT is set to a predetermined addition amount #DKEVACI1 (specifically, 0.001) in step S423. Then, the addition in the steps S415–S417 is performed after which the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

Those values have the following relationships:

*#KAFEFAIH>#KAFEVAIM>#KAFEVAIL*

*#DKEVAIM1<#DKEVAIM2*

*#DKEVACI2<#DKEVACI3<#DKEVACI1*

[Non-idling State]

When F_IDLE=1 is false in step S401 or when the engine body 1 is not idling, it is determined in step S424 whether or not a predetermined time has passed since the engine body 1 has come out of the idle state by checking whether the value of the transition-to-non-idling-state delay timer TKEVACTI (specifically, 2 sec) is "0" or not. This step allows a process similar to the one performed in the idle state to be executed immediately after the engine state has changed to the non-idling state from the idle state, thereby eliminating the influence of a sudden change in the purge-correction-coefficient computation correction coefficient KEVACT on the air-fuel ratio.

When TKEVACTI=0 is false in the step S424 or when the predetermined transition-to-non-idling-state delay time has not elapsed since the transition from the idle state to the non-idling state, the flow proceeds to the aforementioned step S407.

When TKEVACTI=0 in the step S424 or when the predetermined transition-to-non-idling-state delay time has elapsed since the transition from the idle state to the non-idling state, on the other hand, a process nearly the same as that of the steps S407–S423 is carried out with a different determination value and updated value. Specifically, in step S425, the deviation |KCMD−KACT| between the real air-fuel ratio coefficient KACT based on the output of the LAF sensor 17 and the target air-fuel ratio coefficient KCMD is computed, and it is determined whether or not the deviation is equal to or below a predetermined addition switching determination value #DKAFEVAC (specifically, 0.02). In other words, the process of calculating the purge-correction-coefficient computation correction coefficient KEVACT changes depending on whether the deviation |KCMD−KACT| is large or whether the deviation |KCMD−KACT| is small.

When |KCMD−KACT|≦#DKAFEVAC is false in the step S425 or when the deviation |KCMD−KACT| is large, the flow proceeds to step S433 which will be discussed below.

When |KCMD−KACT|≦#DKAFEVAC is true in the step S425 or when the deviation KCMD−KACT| is small, it is determined in step S426 whether the air-fuelratio feedback coefficient KAF is larger than a predetermined large subtraction determination value #KAFEVAH (specifically, 1.078) or not.

When KAF>#KAFEVAH in step S425 or when the air-fuel-ratio feedback coefficient KAF becomes larger than #KAFEVAH which is above the center value, the purge-correction-coefficient computation correction coefficient KEVACT is decreased.

In step S427, the update amount DKEVACT for updating the purge-correction-coefficient computation correction coefficient KEVACT is set to a predetermined subtraction amount #DKEVAM1 (specifically, 0.0005). Then, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KAF>#KAFEVAH is false in the step S426, on the other hand, it is determined in step S428 whether the air-fuel-ratio feedback coefficient KAF is smaller than a predetermined addition switching determination value #KAFEVAL (specifically, 0.953) or not.

When KAF<#KAFEVAL in step S428 or when the air-fuel-ratio feedback coefficient KAF becomes smaller than #KAFEVAL, the purge-correction-coefficient computation correction coefficient KEVACT is increased.

In step S429, the update amount DKEVACT is set to a predetermined addition amount #DKEVACT3 (specifically, 0.002).

Then, the addition in steps S415–S417 is performed after which the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KAF<#KAFEVAL is false in the step S428, it is determined in step S430 whether or not the air-fuel-ratio feedback coefficient KAF is smaller than a predetermined hold determination value #KAFEVAM (specifically, 0.992), which is slightly greater than the addition switching determination value #KAFEVAL.

When KAF<#KAFEVAM is false in step S430, the present cycle of the computation routine (KEVACT_CAL) for the purge-correction-coefficient computation correction coefficient KEVACT is terminated without changing the purge-correction-coefficient computation correction coefficient KEVACT and the flow returns to the flowchart of the computation routine (KAFEVACT_CAL) for the purge correction coefficient KAFEVACT.

When KAF<#KAFEVAM is true in step S430 or the air-fuel-ratio feedback coefficient KAF becomes smaller, it is determined in step S431 whether or not a value acquired by subtracting the target air-fuel ratio coefficient KCMD from the real air-fuel ratio coefficient KACT is equal to or below a predetermined hold determination value #DKAFEVM (specifically, 0.003). When KACT−KCMD≦#DKAFEVM or when the air-fuel ratio is on the lean side, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KACT−KCMD≦#DKAFEVM is false in step S431 or when the air-fuel ratio is on the rich side, on the other hand, the update amount DKEVACT which increases the purge correction coefficient KEVACT is set in step S432.

After the addition in the aforementioned steps S415–S417 is performed, the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

That is, the process in the steps S426–S432 selects the update amount DKEVACT for the purge-correction-coefficient computation correction coefficient KEVACT for correcting the computation routine (KAFEVACT_CAL) for the purge correction coefficient KAFEVACT in accordance with the air-fuel-ratio feedback coefficient KAF, when the deviation |KCMD−KACT| is small. Specifically, when the air-fuel-ratio feedback coefficient KAF is larger than the subtraction determination value #KAFEVAH, the subtraction amount #DKEVAM1 (specifically, 0.0005) is selectively set as the update amount DKEVACT. When KAF lies in a range which is equal to or below the subtraction determination value #KAFEVAH and is equal to or above the hold determination value #KAFEVAM, the purge-correction-coefficient computation correction coefficient KEVACT is not altered. When KAF lies in a range which is smaller than the hold determination value #KAFEVAM which is below the former range and is equal to or above the addition switching determination value #KAFEVAL, a small addition amount #DKEVACT2 (specifically, 0.001) is selectively set as the update amount DKEVACT depending on the conditions. When KAF is smaller than the addition switching determination value #KAFEVAL, a large addition amount #DKEVACT3 (specifically, 0.002) is selectively set as the update amount DKEVACT.

When |KCMD−KACT|≦#DKAFEVAC is false in the step S425 or when the deviation |KCMD−KACT| is large, it is determined in step S433 whether or not the real air-fuel ratio coefficient KACT is smaller than the target air-fuel ratio coefficient KCMD, i.e., whether the real air-fuel ratio is leaner or richer than the target air-fuel ratio.

When KACT<KCMD is true in step S433 or when the real air-fuel ratio is leaner than the target air-fuel ratio, the update amount DKEVACT for updating the purge-correction-coefficient computation correction coefficient KEVACT is set to a predetermined large subtraction amount #DKEVAM2 (specifically, 0.001) in step S434. Then, the subtraction in the steps S410–S412 is executed, after which the present cycle of the computation routine (KEVACT_CAL) for the purge-correction-coefficient computation correction coefficient KEVACT is terminated and the flow returns to the flowchart of the computation routine (KAFEVACT_CAL) for the purge correction coefficient KAFEVACT.

When KACT<KCMD is false in step S433 or when the real air-fuel ratio is richer than the target air-fuel ratio, on the other hand, the update amount DKEVACT for updating the purge-correction-coefficient computation correction coefficient KEVACT is set to a relatively large predetermined addition amount #DKEVACT1 (specifically, 0.003) in step S435. Then, the addition in the steps S415–S417 is performed, after which the present cycle of the computation routine (KEVACT_CAL) for the purge-correction-coefficient computation correction coefficient KEVACT is terminated. and the flow returns to the flowchart of the computation routine (KAFEVACT_CAL) for the purge correction coefficient KAFEVACT.

Those values have the following relationships:

*#KAFEFAH>#KAFEVAM>#KAFEVAL*

*#DKEVAM1<#DKEVAM2*

*#DKEVACT2<#DKEVACT3<#DKEVACT1*

Further,

*#DKEVAM1>#DKEVAIM1*

*#DKEVAM2>#DKEVAIM2*

*#DKEVACT1>#DKEVACI1*

*#DKEVACT2>#DKEVACI2*

*#DKEVACT3>#DKEVACI3*

Figure 8:
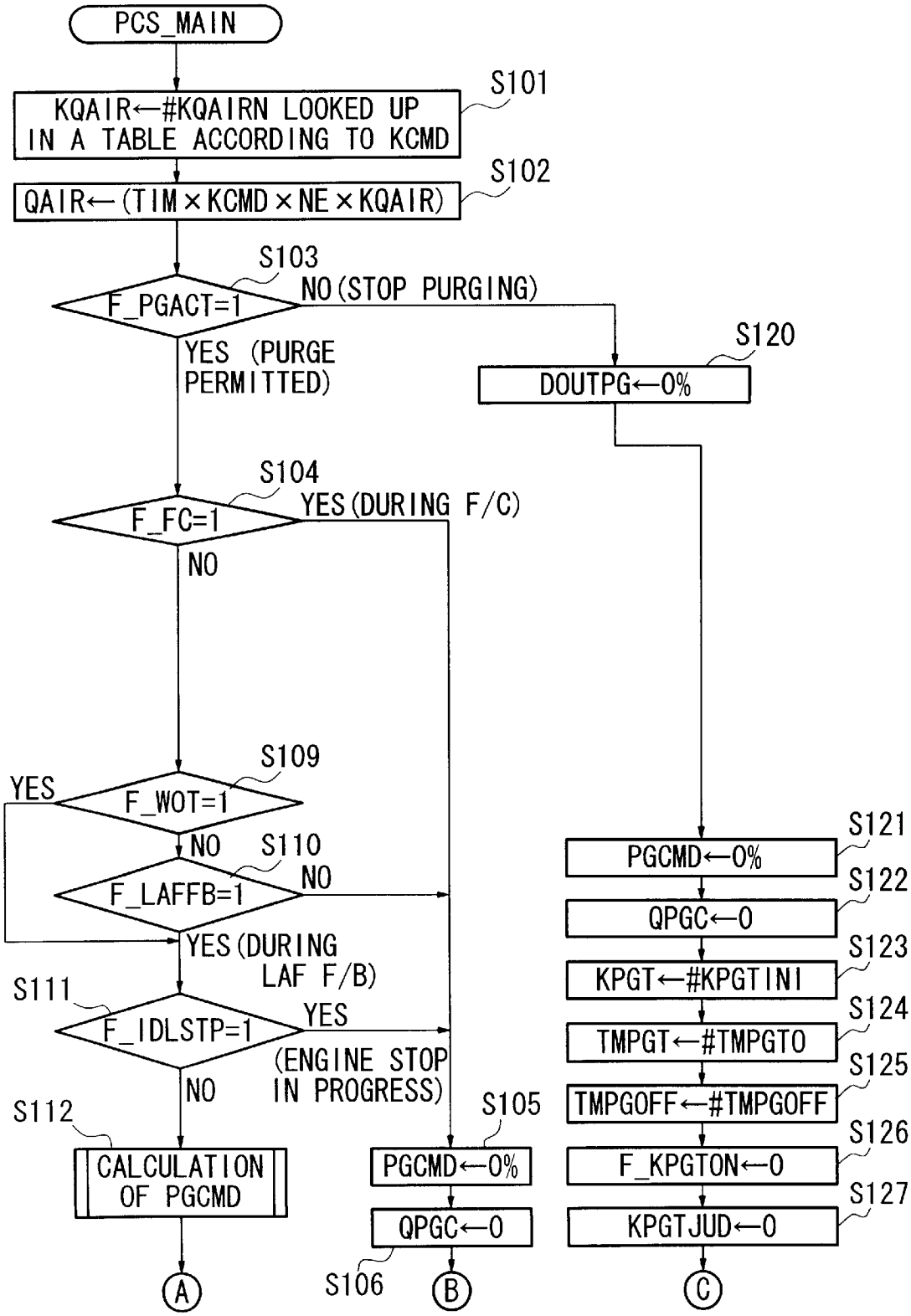
FIG. 8 is a flowchart illustrating a routine of controlling the actuation of a purge control valve for setting a purge flow rate to a predetermined rate.
Figure 9:
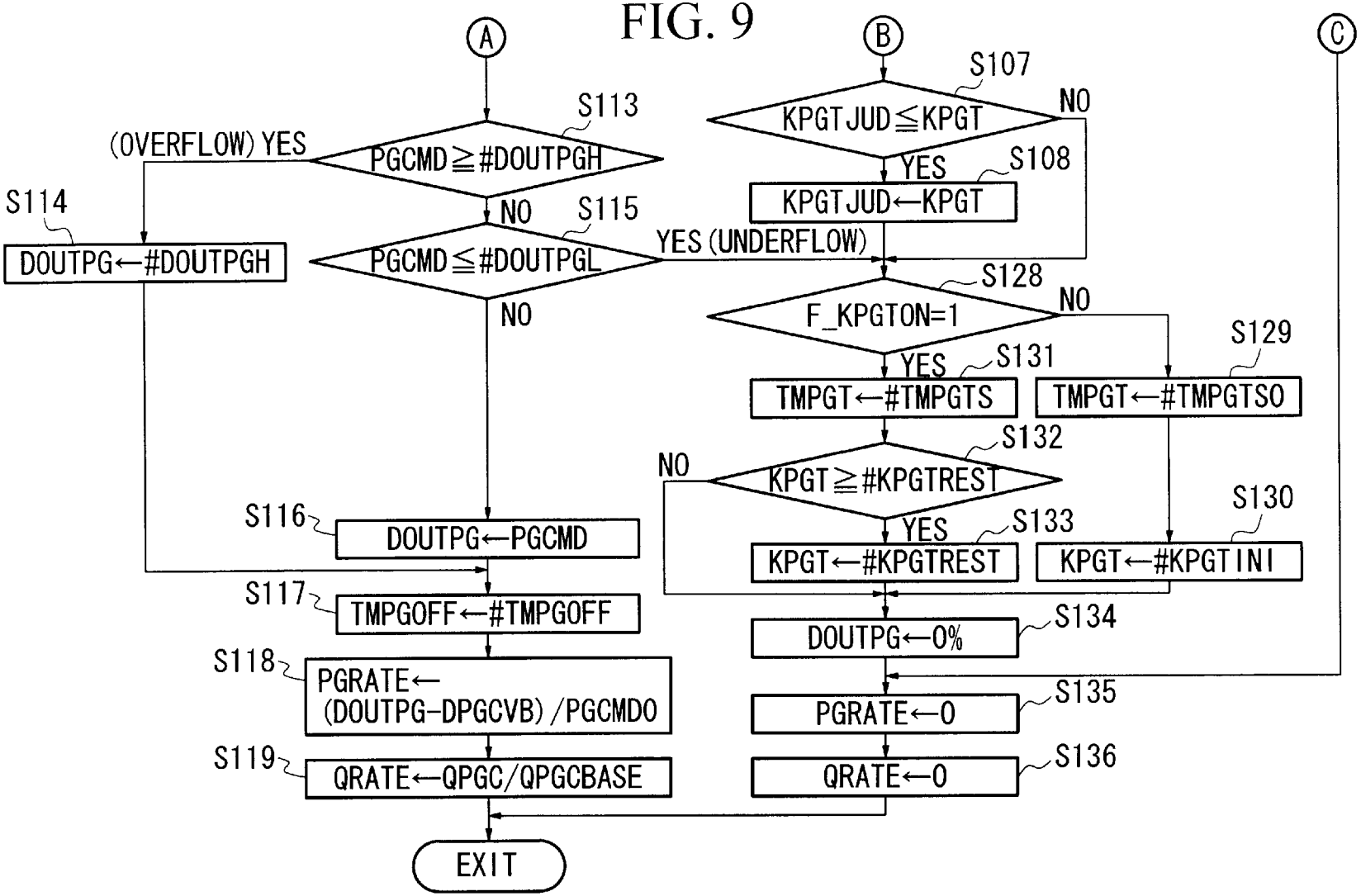
FIG. 9 is a flowchart illustrating a routine of controlling the actuation of the purge control valve for setting the purge flow rate to the predetermined rate.
Figure 10:
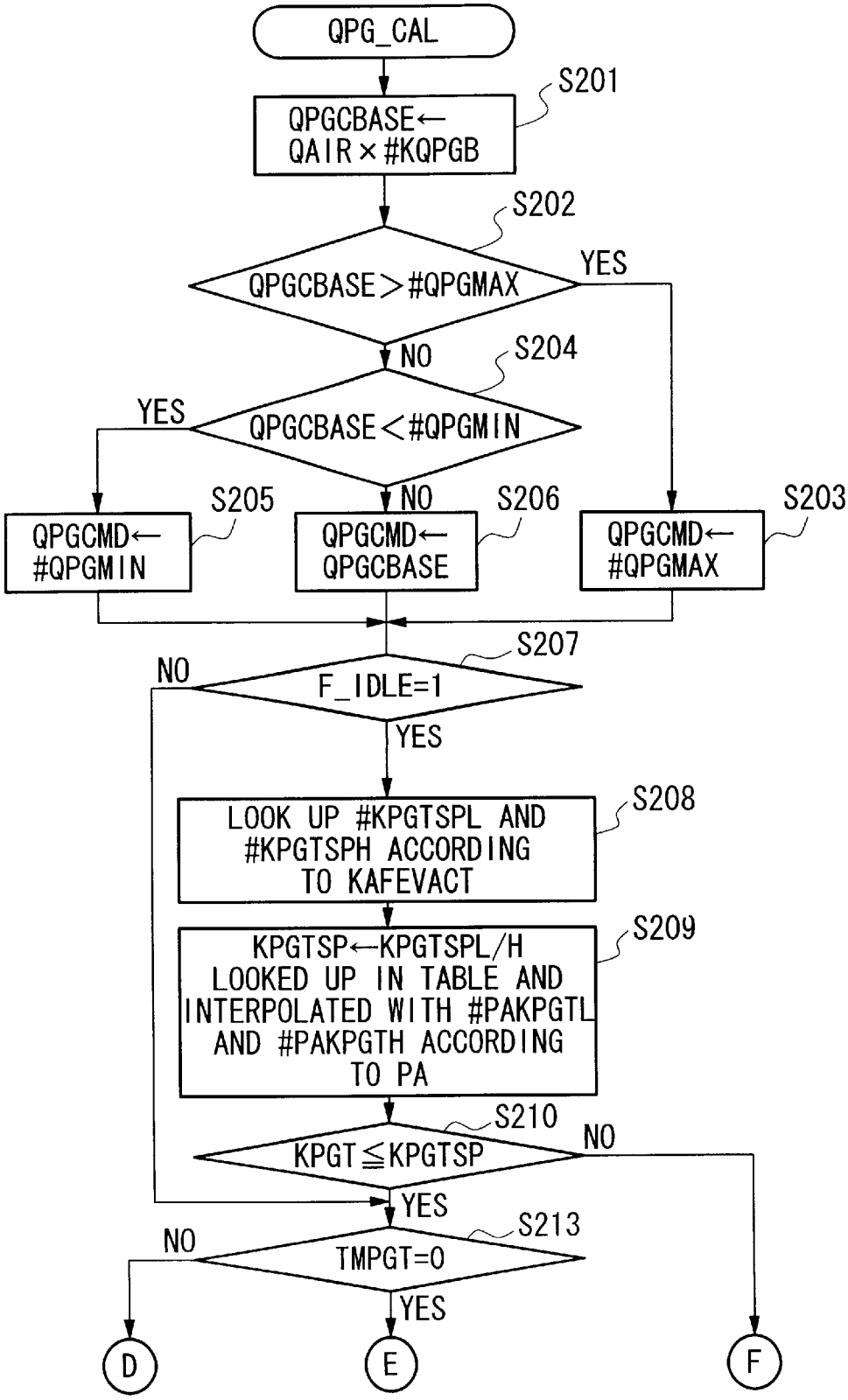
FIG. 10 is a flowchart particularly illustrating a routine of computing a target flow rate (QPG_CAL) in the PGCMD computing routine shown in FIG. 8.
Figure 11:
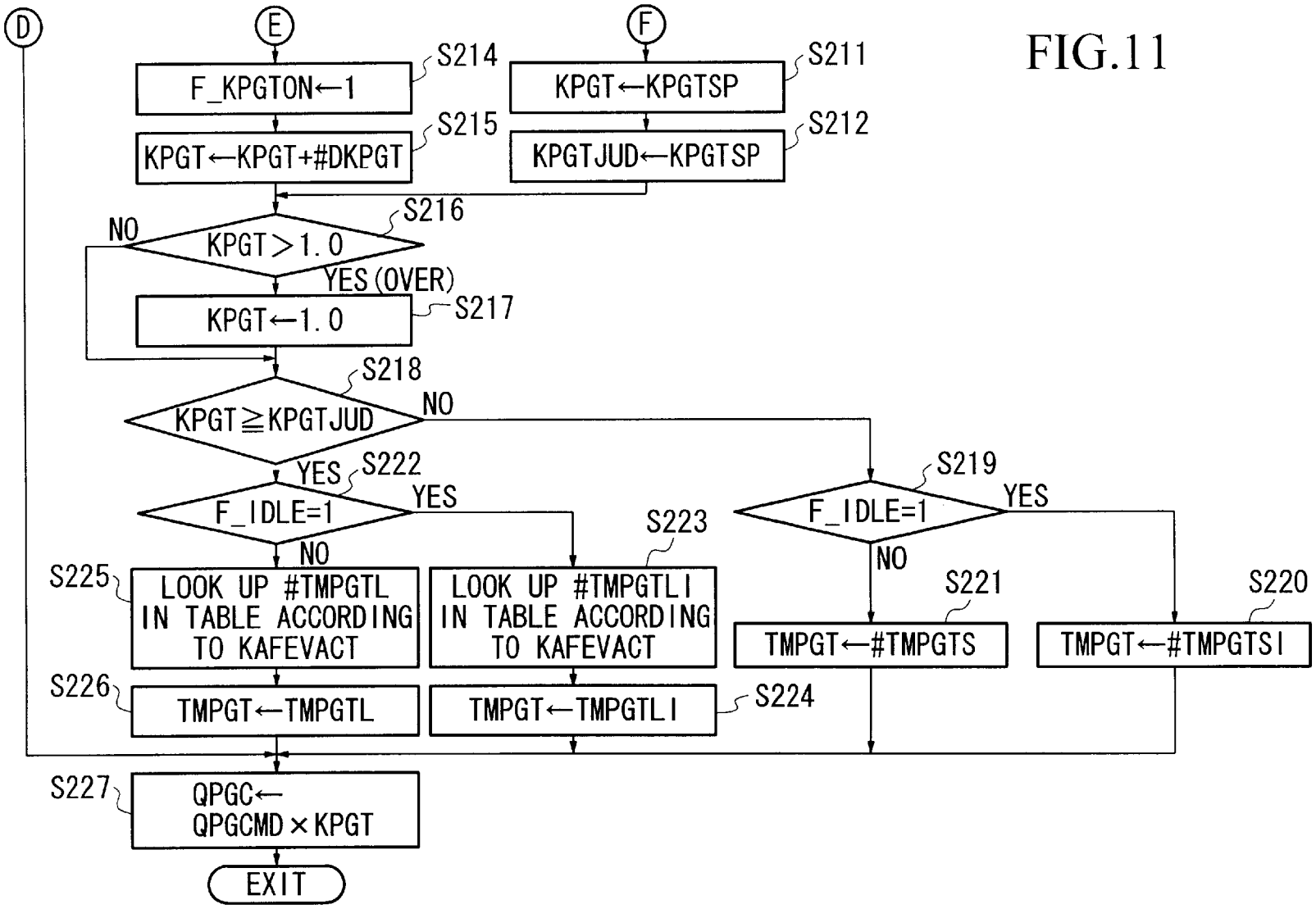
FIG. 11 is a flowchart particularly illustrating the routine for computing the target flow rate (QPG_CAL) in the PGCMD computing routine shown in FIG. 8.
Figure 12:
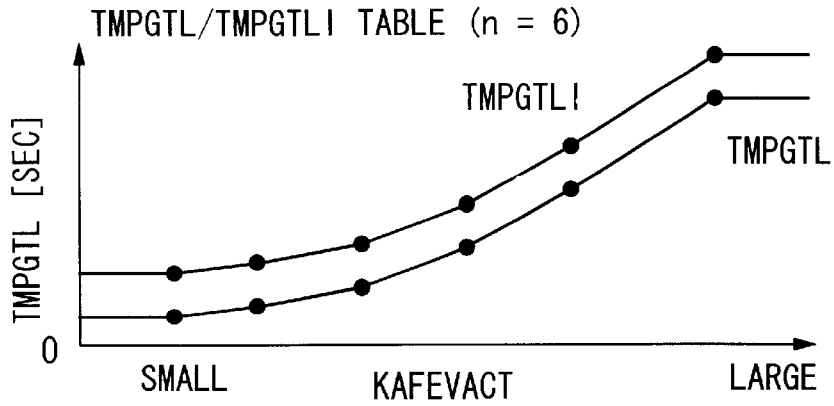
FIG. 12 is a graph showing update timer values TMPGTL/TMPGTLI, which vary in accordance with the purge correction coefficient KAFEVACT.
Figure 13:
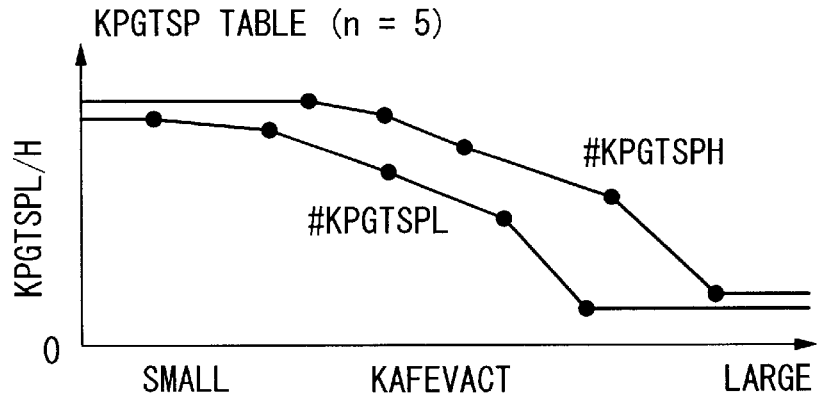
FIG. 13 is a graph showing low-side and high-side purge restriction coefficients KPGTSPL/KPGTSPH, which vary in accordance with the purge correction coefficient KAFEVACT.
Figure 14:
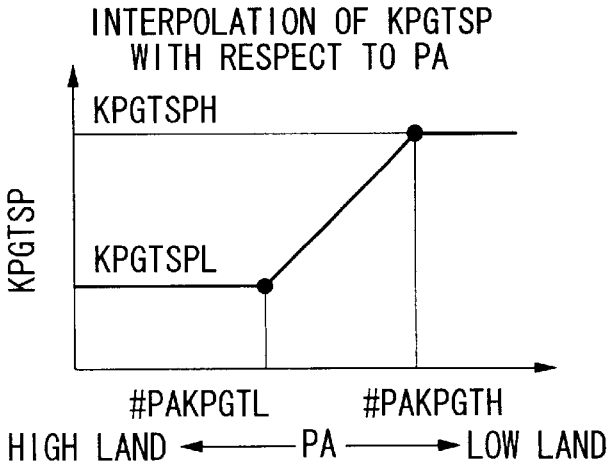
FIG. 14 is a graph showing a purge restriction coefficient KPGTSP, which varies in accordance with atmospheric pressure PA.

FIGS. 8 and 9 are flowcharts illustrating a routine for controlling the actuation of the purge control valve 44 in order to set the purge flow rate to a predetermined rate. FIGS. 10 and 11 are flowcharts particularly illustrating a routine for computing a target flow rate (QPG_CAL) in the PGCMD computing routine shown in FIG. 8. FIG. 12 is a graph showing update timer values TMPGTL/TMPGTLI, which vary in accordance with the purge correction coefficient KAFEVACT. FIG. 13 is a graph showing low-side and high-side purge restriction coefficients KPGTSPL/KPGTSPH, which vary in accordance with the purge correction coefficient KAFEVACT. FIG. 14 is a graph showing a purge restriction coefficient KPGTSP, which varies in accordance with atmospheric pressure PA.

First, in step S101 in FIG. 8, an air flow rate conversion coefficient KQAIR, which is set so as to decrease in accordance with an increase in the target air-fuel ratio coefficient KCMD, is looked up in a table. Note that the target air-fuel ratio coefficient KCMD is proportional to the reciprocal of the air-fuel ratio (A/F) or the fuel-air ratio (F/A), and its value corresponding to the stoichiometric air-fuel ratio is 1.0.

The flow then proceeds to step S102 where an air flow rate QAIR is set to a value acquired by multiplying the basic fuel injection amount TIM, which is set in accordance with the engine speed NE of the engine body 1 and the intake-tube absolute pressure PBA, the target air-fuel ratio coefficient KCMD, the engine speed NE and the air flow rate conversion coefficient KQAIR together. The air flow rate QAIR is the flow rate of the air that is supplied to the engine body 1.

Next, the flow proceeds to step S103, where it is determined whether the value of a purging permission flag F_PGACT for determining if purging is permitted by actuating the purge control valve 44 is "1" or not. The permission for purging is set in accordance with, for example, the coolant temperature or the like of the engine body 1.

When the determination is NO or when it is judged that purging is to be stopped, a process starting at step S120 to be discussed below is executed.

When the determination is YES in step S103 or when it is judged that purging is permitted, on the other hand, the flow proceeds to step S104 where it is determined whether the value of a fuel cut-off flag F_FC is "1" or not.

When the determination is YES or when it is judged that the fuel supply to the engine body 1 is cut off, the flow proceeds to step S105.

In step S105, a target purge-control-valve actuation duty value PGCMD, which will be discussed below, is set to 0%. The flow then proceeds to step S106, where a target purge flow rate QPGC is set to "0", after which the flow proceeds to step S107. The purge-control-valve actuation duty value is a duty ratio at the time the purge control valve 44 is actuated by, for example, PWM.

In step S107 in FIG. 9, it is determined whether the purge flow rate restriction coefficient for judgement KPGTJUD is equal to or below a purge flow rate restriction coefficient KPGT.

When the determination is NO, a process starting at step S128 to be discussed below is executed. When the determination is YES, on the other hand, the flow proceeds to step S108 to set the purge flow rate restriction coefficient KPGTJUD to the purge flow rate restriction coefficient KPGT. The flow then proceeds to step S128, which will be discussed below.

The purge flow rate restriction coefficient KPGTJUD serves to hold the value of the purge flow rate restriction coefficient KPGT that has been set before the temporary stopping of purging in the case where, for example, purging has been restarted after having been temporarily stopped.

When the determination in step S104 is NO, on the other hand, the flow proceeds to step S109.

In step S109, it is determined whether the value of a wide-open increment flag F_WOT is "1" or not.

When the determination is YES, the flow proceeds to step S111, which will be discussed below. When the determination is NO, on the other hand, the flow proceeds to step S110.

In step S110, it is determined whether the value of the feedback control execution flag F_LAFFB for controlling the air-fuel ratio of the engine body 1 to the target air-fuel ratio by, for example, PID control or the like based on the output of the LAF sensor 17 is "1" or not.

When the determination is NO, the flow proceeds to step S105. When the determination is YES, on the other hand, the flow proceeds to step S111.

In step S111, it is determined whether the value of the idle stop flag F_IDLSTP is "1" or not.

The "idle stop" is to stop the engine body 1 by cutting fuel supply to the engine body 1 under the control of the ECU 5, thereby inhibiting unnecessary idling to save fuel.

The following are some examples of the case where the idle stop flag F_IDLSTP is set to "1":

(1) After the vehicle speed V reaches a predetermined velocity (including zero) at the time of, for example, decelerating the vehicle, the shift position is at the neutral or P (Park) position.

(2) Even when the shift position is at the D (Drive) position or the R (Reverse) position, the brake pedal is depressed.

It is to be noted however that it is determined whether the engine body 1 can be restarted by activating the starter motor (not shown) even if the engine body 1 is stopped, and if there is not sufficient power left, the engine body 1 is not stopped and is kept idling.

One example of the case where the engine body 1 is restarted from the idling stop state is when the clutch switch (not shown) becomes ON so that the shift position comes to an in-gear position. In this case, the ECU 5 automatically activates the starter motor to start the engine body 1.

When the determination is YES in step S111 or when it is judged that stopping the idling of the engine body 1 is underway, the flow proceeds to step S105.

When this determination is NO or when it is judged that stopping idling is not underway, on the other hand, the flow proceeds to step S112, where a PGCMD calculation process which will be discussed below is executed. Then, the flow proceeds to step S113.

In other words, the flow of air to the engine body 1 is suppressed by stopping purging when the engine body 1 changes to the idling stop state. This prevents the occurrence of a so-called dieseling phenomenon, which originates from the compression of the air, thereby suppressing the occurrence of vibration or the like in the engine body 1.

In step S113 in FIG. 9, it is determined whether the target purge-control-valve actuation duty value PGCMD is equal to or above a predetermined high-side purge-control-valve actuation duty threshold value #DOUTPGH (e.g., 100%).

When the determination is YES or when it is judged that the target purge-control-valve actuation duty value PGCMD is overflowing, the flow proceeds to step S114 to set the high-side purge-control-valve actuation duty threshold value #DOUTPGH to the purge-control-valve actuation duty value DOUTPG. Then, the flow proceeds to step S117, which will be discussed below.

When the determination is NO in step S113 or when it is judged that the target purge-control-valve actuation duty value PGCMD is not overflowing, on the other hand, the flow proceeds to step S115. In step S115, it is determined whether the target purge-control-valve actuation duty value PGCMD is equal to or below a predetermined lowside purge-control-valve actuation duty threshold value #DOUTPGL (e.g., 0%).

When the determination is YES or when it is judged that the target purge-control-valve actuation duty value PGCMD is underflowing, the flow proceeds to step S128 to be discussed below.

When the determination is NO in step S115 or when it is judged that the target purge-control-valve actuation duty value PGCMD is not underflowing, on the other hand, the flow proceeds to step S116 to set the target purge-control-valve actuation duty value PGCMD to the purge-control-valve actuation duty value DOUTPG. Then, the flow proceeds to step S117.

In step S117, a predetermined-time-after-purge-OFF detection timer TMPGOFF is set to a predetermined timer value #TMPGOFF (e.g., 1.0 sec) and the flow proceeds to step S118.

In step S118, a value which is obtained by subtracting a purge-control-valve actuation duty value voltage correction DPGCVB from the purge-control-valve actuation duty value DOUTPG is divided by an initial target purge-control-valve actuation duty value PGCMD0, and the purge-control-valve duty ratio PGRATE is set to the resultant value.

The purge-control-valve actuation duty value voltage correction DPGCVB corrects the rising delay of the purge-control-valve actuation duty value DOUTPG in accordance with the voltage that is supplied to the purge control valve 44 and is set so as to become smaller as the voltage to be supplied to the purge control valve 44 increases.

In the next step S119, the target purge flow rate ratio QRATE is set to the value which is obtained by dividing the target purge flow rate QPGC by a target purge flow rate basic value QPGCBASE. Then, the sequence of processes is terminated.

In step S120 in FIG. 8, the purge-control-valve actuation duty value DOUTPG is set to 0%. Then, the target purge-control-valve actuation duty value PGCMD is set to 0% (step S121), and the target purge flow rate QPGC is set to "0" (step S122). The flow then proceeds to step S123.

In step S123, the purge flow rate restriction coefficient KPGT is set to a predetermined flow-rate-at-start-of-purge restriction coefficient #KPGTMI (e.g., 0.120). Then, a KPGT (purge flow rate restriction coefficient) update timer TMPGT is set to a predetermined after-start update timer value #TMPGT0 (e.g., 10 sec) (step S124). Next, the predetermined-time-after-purge-OFF detection timer TMPGOFF is set to the predetermined timer value #TMPGOFF (e.g., 1.0 sec) (step S125). Then, the flow proceeds to step S126.

In step S126, the value of a KPGT (purge flow rate restriction coefficient) calculation flag F_KPGTON is set to "0". Then, the purge flow rate restriction coefficient KPGT- JUD is set to "0" (step S127) after which a process starting at step S135 to be discussed below is performed.

In step S128, it is determined whether the value of the KPGT calculation flag F_KPGTON is "1" or not.

When the determination is NO or when it is judged that the calculation of the purge flow rate restriction coefficient KPGT is not underway, for example, immediately after the engine body 1 is activated or immediately after purging is restarted after temporary termination of purging, the KPGT update timer TMPGT is set to a predetermined update timer value #TMPGTSO (e.g., 5 sec) (step S129). Then, the purge flow rate restriction coefficient KPGT is set to the predetermined flow-rate-at-start-of-purge restriction coefficient #KPGTINI (e.g., 0.102) (step S130). Then, a process starting at step S134 to be discussed below is performed.

When the determination is YES in step S128 or when it is judged that the calculation of the purge flow rate restriction coefficient KPGT is underway at the beginning of purging or the like, the KPGT update timer TMPGT is set to a predetermined update timer value #TMPGTS (e.g., 0.3 sec) (step S131). Then, it is determined whether or not the purge flow rate restriction coefficient KPGT is equal to or above a predetermined flow-rate-at-restart-of-purge restriction coefficient #KPGTREST (e.g., 0.320) (step S132).

When the determination is NO, a process starting at step S134 to be discussed below is performed. When the determination is YES, on the other hand, the purge flow rate restriction coefficient KPGT is set to the predetermined flow-rate-at-restart-of-purge restriction coefficient #KPGTREST (e.g., 0.320) (step S133). Then, the flow proceeds to step S134.

In step S134, the purge-control-valve actuation duty value DOUTPG is set to 0% after which the flow proceeds to step S135.

In step S135, the purge-control-valve duty ratio PGRATE is set to "0". Then, the target purge flow rate ratio QRATE is set to "0" (step S136), after which the sequence of processes is terminated.

A description will now be given of the process of calculating PGCMD in the step S112 by referring to the accompanying drawings. This process computes the target purge flow rate QPGC and calculates the target purge-control-valve actuation duty value PGCMD based on the target purge flow rate QPGC. The following particularly discusses the computation of the target purge flow rate QPGC.

First, in step S201 in FIG. 10, the target purge flow rate basic value QPGCBASE is set to a value obtained by multiplying the air flow rate QAIR by a predetermined target purge ratio #KQPGB (e.g., 0.150). Then, the flow proceeds to step S202.

The target purge ratio #KQPGB is a correction coefficient which corrects a change in the purge flow rate in accordance with the intake-tube absolute pressure PBA even if, for example, the degree of opening of the purge control valve 44 is constant.

In step S202, it is determined whether or not the target purge flow rate basic value QPGCBASE is larger than a predetermined purge flow rate upper limit #QPGMAX (e.g., 35 litters/min).

When the determination is YES, the flow proceeds to step S203 to set a target purge flow rate value QPGCMD to the purge flow rate upper limit #QPGMAX. Then, the flow proceeds to step S207.

When the determination is NO in step S202, the flow proceeds to step S204 to determine whether or not the target purge flow rate basic value QPGCBASE is smaller than a predetermined purge flow rate lower limit #QPGMIN (e.g., 0).

When the determination is YES, the flow proceeds to step S205 to set the target purge flow rate value QPGCMD to the purge flow rate lower limit #QPGMIN. Then, the flow proceeds to step S207.

When the determination is NO in step S204, the flow proceeds to step S206 to set the target purge flow rate value QPGCMD to the target purge flow rate basic value QPGCBASE. Then, the flow proceeds to step S207.

In step S207, it is determined whether the value of the idle flag F_IDLE is "1" or not.

When the determination is NO or when it is judged that the engine body 1 is not idling, the flow proceeds to step S213, which will be discussed below.

When the determination is YES in step S207, however, the flow proceeds to step S208 where, as shown in FIG. 13, the low-land-side purge restriction coefficient #KPGTSPL and high-land-side purge restriction coefficient #KPGTSPH, which are set so as to decrease as the purge correction coefficient KAFEVACT increases, are looked up in the table.

This particular setting of both purge restriction coefficients #KPGTSPL/H as shown in FIG. 13 reduces the purge flow rate when the purge concentration is high, and shortens the open time of the fuel injection valve 12, so that the minimum fuel amount required can be secured.

In step S209, as shown in FIG. 14, the low-land-side and high-land-side purge restriction coefficients KPGTSPL/H are associated with a predetermined low-land-side lattice point #PAKPGTL (e.g., 61.3 kPa) and a predetermined high-land-side lattice point #PAKPGTH (97.3 kPa), both being associated with the atmospheric pressure PA, respectively and in order, and the purge restriction coefficient KPGTSP is obtained by performing interpolation on the adequate value of the atmospheric pressure PA.

Specifically, because the amount of fuel during idling decreases on high land, for example, the purge restriction coefficient KPGTSP is reduced.

In step S210, it is determined whether or not the purge flow rate restriction coefficient KPGT is equal to or below the purge restriction coefficient KPGTSP.

When the determination is NO, the flow proceeds to step S211 in FIG. 11 to set the purge flow rate restriction coefficient KPGT to the purge restriction coefficient KPGTSP. Then, the purge flow rate restriction coefficient KPGTJUD is set to the purge restriction coefficient KPGTSP (step S212). Then, a process starting at step S216 to be discussed below is performed.

When the determination is YES in step S210, the flow proceeds to step S213 to determine whether the KPGT update timer TMPGT is "0" or not.

When the determination is NO, a process starting at step S227 to be discussed below is performed.

When the determination is YES in step S213, the flow proceeds to step S214 in FIG. 11 to set the value of the KPGT calculation flag F_KPGTON to "1".

Next, a value obtained by adding a predetermined addition amount #DKPGT (e.g., 0.008) to the purge flow rate restriction coefficient KPGT is set as a new purge flow rate restriction coefficient KPGT (step S215). Then, the flow proceeds to step S216.

In step S216, it is determined whether the purge flow rate restriction coefficient KPGT is larger than "1.0" or not.

When the determination is NO, the flow proceeds to step S218, which will be discussed below. When the determination is YES, the purge flow rate restriction coefficient KPGT is set to "1.0" (step S217) and the flow proceeds to step S218.

In step S218, it is determined whether or not the purge flow rate restriction coefficient KPGT is equal to or above the purge flow rate restriction coefficient KPGTJUD.

When the determination is NO, the flow proceeds to step S219 to determine whether the value of the idle flag F_IDLE is "1" or not.

When the determination is YES in step S219, the KPGT update timer TMPGT is set to a predetermined update timer value #TMPGTSI (e.g., 2.8 sec) (step S220). Then, a process starting at step S227, to be discussed below, is performed.

When the determination is NO in step S219, on the other hand, the KPGT update timer TMPGT is set to the predetermined update timer value #TMPGTS (e.g., 0.3 sec) (step S221). Then, a process starting at step S227 to be discussed below is performed.

When the determination is YES in step S218, the flow proceeds to step S222 to determine whether the value of the idle flag F_IDLE is "1" or not.

When the determination is YES in step S222, an update timer look-up value TMPGTLI is obtained by looking up an update timer value #TMPGTLI, which is set so as to increase in accordance with an increase in the purge correction coefficient KAFEVACT as shown in FIG. 12, in the table (step S223).

Then, the KPGT update timer TMPGT is set to the update timer value TMPGTLI (step S224) and a process starting at step S227, to be discussed below, is performed.

When the determination is NO in step S222, on the other hand, an update timer look-up value TMPGTL is obtained by looking up an update timer value #TMPGTL, which is set so as to increase in accordance with an increase in the purge correction coefficient KAFEVACT as shown in FIG. 12, in the table (step S225). Then, the KPGT update timer TMPGT is set to the update timer value TMPGTL, (step S226) and the flow proceeds to step S227.

In step S227, the target purge flow rate QPGC is set to a value acquired by multiplying the target purge flow rate value QPGCMD by the purge flow rate restriction coefficient KPGT. Then, the sequence of processes is terminated.

As apparent from the above, when the purge flow rate restriction coefficient KPGT gradually increases and becomes equal to the purge restriction coefficient KPGTSP, the update speed of the purge flow rate restriction coefficient KPGT is reduced. Further, the update speed of the purge flow rate restriction coefficient KPGT is lowered during idling.

In the above-described embodiment, the purge-correction-coefficient computation correction coefficient KEVACT is acquired in accordance with the real air-fuel ratio coefficient KACT or the output of the LAF sensor 17 through both the process in step S023 in the flowchart in FIG. 2 or the routine of calculating the purge-correction-coefficient computation correction coefficient KEVACT illustrated in the flowcharts of FIGS. 15 and 16, and the process in step S025 of setting the computation routine (KAFEVACT_CAL) for the purge correction coefficient KAFEVACT by multiplying the predetermined target purge correction coefficient KAFEVACZ by the purge-correction-coefficient computation correction coefficient KEVACT, and the computation routine (KAFEVACT_CAL) for the purge correction coefficient KAFEVACT is corrected in accordance with the purge-correction-coefficient computation correction coefficient KEVACT.

As shown in the flowcharts of FIGS. 15 and 16, the routine for calculating the purge-correction-coefficient computation correction coefficient KEVACT obtains the difference between the real air-fuel ratio coefficient KACT and the target air-fuel ratio coefficient KCMD in steps S407 and S425, and sets the size of the update amount DKEVACT for updating the purge-correction-coefficient computation correction coefficient KEVACT in accordance with the difference in the subsequent steps of steps S407 and S425. As a result, the purge-correction-coefficient computation correction coefficient KEVACT is obtained in accordance with the real air-fuel ratio coefficient KACT or the output of the LAF sensor 17. In step S025, the computation routine (KAFEVACT_CAL) for the purge correction coefficient KAFEVACT is set by multiplying the purge-correction-coefficient computation correction coefficient KEVACT by the predetermined target purge correction coefficient KAFEVACZ.

As apparent from the above, the computation routine (KAFEVACT_CAL) for the purge correction coefficient KAFEVACT or the correction amount for correcting the amount of fuel is not controlled so as to approach the target value in a step-like manner by an increment by a predetermined value, but is corrected by the computation routine (KAFEVACT_CAL) for the purge correction coefficient KAFEVACT that is set in accordance with the output of the LAF sensor 17. It is therefore possible to implement finer correction control on the fuel injection valve 12 with respect to the purge amount of the fuel vapor.

In the routine of calculating the purge-correction-coefficient computation correction coefficient KEVACT in FIGS. 15 and 16, when the deviation between the real air-fuel ratio coefficient KACT detected by the LAF sensor 17 and the target air-fuel ratio coefficient KCMD is large (specifically, larger than the predetermined addition switching determination value #DKAFEVIC) in the determination in step S407, the processes in steps S422 and S423 increase the update amount DKEVACT to update the purge-correction-coefficient computation correction coefficient KEVACT for correcting the purge correction coefficient KAFEVACT, and when the deviation is small, the processes in steps S409, S414 and S420 decrease the update amount DKEVACT. Likewise, when the deviation between the real air-fuel ratio coefficient KACT detected by the LAF sensor 17 and the target air-fuel ratio coefficient KCMD is large (specifically, larger than the predetermined addition switching determination value #DKAFEVAC) in the determination in step S425, the processes in steps S434 and S435 increase the update amount DKEVACT to update the purge-correction-coefficient computation correction coefficient KEVACT for correcting the purge correction coefficient KAFEVACT, and when the deviation is small, the processes in steps S427, S429 and S432 decrease the update amount DKEVACT.

When the deviation between the real air-fuel ratio coefficient KACT and the target air-fuel ratio coefficient KCMD is large, as in the case where, for example, a large amount of purging is performed or the like, and therefore, the update amount DKEVACT to update the purge-correction-coefficient computation correction coefficient KEVACT for correcting the purge correction coefficient KAFEVACT is increased. This can shorten the time needed to decrease the deviation so that the air-fuel ratio can approach the target air-fuel ratio instantaneously. When the deviation is small, on the other hand, the update amount DKEVACT is decreased, making it possible to avoid hunching, which would occur due to the purge-correction-coefficient computation correction coefficient KEVACT changing too significantly, shocks during driving, a reduction in the engine speed during idling, and so forth.

In addition, when the idling of the engine body 1 is detected in step S401 in the routine for calculating the purge-correction-coefficient computation correction coefficient KEVACT in FIGS. 15 and 16, and when a variation in the load of the engine body 1 is detected in steps S403 and S404 during idling, the purge-correction-coefficient computation correction coefficient KEVACT is initialized to a predetermined limit value #KEVACTAC in step S406.

Even if the purge-correction-coefficient computation correction coefficient KEVACT increases considerably as in the case where, for example, a high-concentration fuel vapor is produced at a high temperature, and therefore, when a variation in the load of the engine body 1 is detected during idling, the purge-correction-coefficient computation correction coefficient KEVACT is initialized to a predetermined limit value. This prevents the idling speed from becoming lower due to the over-lean state that would occur as the purge correction coefficient KAFEVACT cannot respond to the change in the load immediately after the load variation.

It is therefore possible to ensure stable idling at a high temperature.

When a change in the load of the idling engine body 1 is detected and the purge-correction-coefficient computation correction coefficient KEVACT is equal to or below the limit value #KEVACTAC in step S405, the purge-correction-coefficient computation correction coefficient KEVACT is not initialized to the limit value #KEVACTAC. This can prevent the idling speed from becoming lower by over-correction.

When the idling of the engine body 1 is detected in step S401 in the routine for calculating the purge-correction-coefficient computation correction coefficient KEVACT in FIGS. 15 and 16, as apparent from steps S409, S422, S423, S420 and S414, the update amount DKEVACT of the purge-correction-coefficient computation correction coefficient KEVACT is made smaller than the update amount DKEVACT in the associated one of steps S427, S434, S435, S432 and S429 in the non-idling state. Specifically, the update amount DKEVACT in step S427 in the non-idling state is set to #DKEVAM1, whereas the update amount DKEVACT in the associated step S409 in the idle state is set to a #DKEVAIM1 smaller than #DKEVAM1. Likewise, the update amount DKEVACT in step S434 in the non-idling state is set to #DKEVAM2, whereas the update amount DKEVACT in the associated step S422 in the idle state is set to a #DKEVAIM2 smaller than #DKEVAM2. Likewise, the update amount DKEVACT in step S435 in the non-idling state is set to #DKEVACT1, whereas the update amount DKEVACT in the associated step S423 in the idle state is set to a #DKEVACI1 smaller than #DKEVACT1. Likewise, the update amount DKEVACT in step S432 in the nonidling state is set to #DKEVACT2, whereas the update amount DKEVACT in the associated step S420 in the idle state is set to a #DKEVACI2 smaller than #DKEVACT2. Likewise, the update amount DKEVACT in step S429 in the non-idling state is set to #DKEVACT3, whereas the update amount DKEVACT in the associated step S414 in the idle state is set to a #DKEVACI3 smaller than #DKEVACT3.

Again, the purge-correction-coefficient computation correction coefficient KEVACT when the engine body 1 is idling is set smaller than the update amount DKEVACT in the associated step when the engine body 1 is not idling. When the engine body 1 is running in the non-idling state, the update amount DKEVACT is increased to make the correction speed faster, thus securing the purge amount. Additionally, the update amount DKEVACT is reduced in the idle state, thus preventing the over-lean state or the like originating from the over-correction that would occur in the idle state at a high temperature. This can ensure the stable idling.

Therefore, the amount of purging during driving and the stable idling at a high temperature can both be satisfied.

What is more, when the engine body 1 is idling, the transition-to-non-idling-state delay timer TKEVACTI is set to the predetermined transition-to-non-idling-state delay timer value #TMKEVACI in step S402 and starts counting down. Even if the engine body 1 subsequently comes out of the idle state, the update amount DKEVACT of the purge-correction-coefficient computation correction coefficient KEVACT is made smaller, as in the case of the idle state, than the associated update amount DKEVACT in the non-idling state until the transition-to-non-idling-state delay timer TKEVACTI becomes zero in step S424. This can prevent shocks from occurring due to a sudden change in the purge correction coefficient KAFEVACT when the engine state changes to the non-idling state from the idle state.

As specifically described above, according to the first aspect of the invention, when a deviation between the real air-fuel ratio and the target air-fuel ratio is large, the update amount setting means sets a large update amount with which the purge correction amount updating means updates the purge correction amount for correcting the amount of fuel. Even when the purge amount changes drastically due to a change in the running state of the internal combustion engine, therefore, correction of the fuel amount corresponding to the purge amount is carried out properly. This prevents the exhaust component characteristic from deteriorating. It is therefore possible to ensure finer correction control of the fuel supply means with respect to the purge amount of the fuel vapor.

According to the second aspect of this invention, when the idle determination means had determined that the internal combustion engine is in an idle state and the load change detection means has detected a change in the load, the purge-correction-amount initialization means initializes the purge correction amount for correcting the amount of fuel. In the case where the load varies in the idle state, even when the purge amount varies in accordance with the change in the load, the fuel amount can be corrected adequately to prevent the air-fuel ratio from becoming lean. This prevents the running of the engine from becoming unstable. It is therefore possible to ensure finer correction control of the fuel supply means with respect to the purge amount of the fuel vapor.

According to the third aspect of this invention, when the idle determination means has determined that the internal combustion engine is in an idle state, the update amount setting means sets a smaller update amount smaller when the internal combustion engine is in the idle state than when the internal combustion engine is not in the idle state, and the purge-correction-amount updating means updates the purge correction amount with that update amount. As the update amount is made smaller when the internal combustion engine is in the idle state, the running of the engine will not become unstable. As the update amount is made larger when the internal combustion engine is in other states than the idle state, the correction can properly respond to the influence of purging so that the exhaust component characteristic will not deteriorate. It is therefore possible to ensure finer correction control on the fuel supply means with respect to the purge amount of the fuel vapor.

According to the fourth aspect of the invention, the update amount calculator determines the update amount of the purge correction amount, depending on the target air-fuel ratio set by the target air-fuel ratio setting device. When the actual air-fuel ratio is leaner than the target air-fuel ratio, the update amount of the purge correction amount is changed gradually, thereby preventing a decrease in the engine speed and the engine from stopping due to the over-lean state.

According to the fifth aspect of the present invention, when executing the purge cutting, the decreasing correction value for correcting the amount of fuel to be supplied to the internal combustion engine, is not immediately set to 0, and gradually becomes 0, thereby preventing the rich-state of the actual air-fuel ratio due to the fuel vapor remaining in the system.

What is claimed is:

1. A control apparatus for an internal combustion engine comprising:

a fuel supply device for supplying fuel to the internal combustion engine;

a fuel tank for retaining fuel;

a purge device for purging fuel vapor, produced in the fuel tank, into an intake system of the internal combustion engine;

a purge correction amount calculator for calculating a purge correction amount for correcting an amount of fuel to be supplied by the fuel supply device, depending on the amount of fuel vapor purged by the purge device;

a target air-fuel ratio setting device for setting a target air-fuel ratio, including an air-fuel ratio leaner than the stoichiometric air-fuel ratio, depending on a running state of the internal combustion engine; and an update amount setting device for setting an update amount for updating the purge correction amount depending on the target air-fuel ratio set by the target air-fuel ratio setting device.

2. A control apparatus according to claim 1, further comprising:

an air-fuel ratio detection device, provided in an exhaust system of the internal combustion engine, for detecting an actual air-fuel ratio and sending an electric signal proportional to the actual air-fuel ratio to the update amount setting device, wherein the update amount setting device sets the update amount which becomes larger as a deviation between the actual air-fuel ratio detected by the air-fuel ratio detection device and the target air-fuel ratio becomes larger.

3. A control apparatus according to claim 1, further comprising:

an idle determination device for determining whether the internal combustion engine is in an idle state; and a load change detection device for detecting a change in a load of the internal combustion engine, wherein the update amount setting device comprises a purge-correction-amount initialization device for initializing a purge correction amount for correcting the amount of fuel when the idle determination device determines that the internal combustion engine is in the idle state and when the load change detection device detects a change in the load.

4. A control apparatus according to claim 1, further comprising:

an idle determination device for determining whether the internal combustion engine is in an idle state, wherein the update amount setting device sets an update amount when the internal combustion engine is in the idle state that is smaller than when the internal combustion engine is not in the idle state.

5. A control apparatus according to claim 1, wherein the purge correction amount calculator gradually decreases the correction amount when stopping the purging.

6. A method for controlling an internal combustion engine comprising:

a fuel supply step of supplying fuel to the internal combustion engine;

a purge step of purging fuel vapor, produced in a fuel tank, into an intake system of the internal combustion engine;

a purge correction amount calculating step of calculating a purge correction amount for correcting an amount of fuel to be supplied in the fuel supply step, depending on the amount of fuel vapor purged in the purge step;

a target air-fuel ratio setting step of setting a target air-fuel ratio, including an air-fuel ratio leaner than the stoichiometric air-fuel ratio, depending on a running state of the internal combustion engine; and an update amount setting step of updating the purge correction amount depending on the target air-fuel ratio set in the target air-fuel ratio setting step.

7. A method according to claim 6, further comprising:

an air-fuel ratio detection step of detecting an actual air-fuel ratio in an exhaust system of the internal combustion engine and generating an electric signal proportional to the actual air-fuel ratio to be used in the update amount setting step, wherein in the update amount setting step, the update amount is set so as to become larger as a deviation between the air-fuel ratio detected in the air-fuel ratio detection step and the target air-fuel ratio becomes larger.

8. A method according to claim 6, further comprising:

an idle determination step of determining whether the internal combustion engine is in an idle state; and a load change detection step of detecting a change in a load of the internal combustion engine, wherein the update amount setting step comprises a purge-correction-amount initialization step of initializing a purge correction amount for correcting the amount of fuel when it is determined in the idle determination step that the internal combustion engine is in the idle state and when it is determined in the load change detection step that there is a change in the load.

9. A method according to claim 6, further comprising:

an idle determination step of determining whether the internal combustion engine is in an idle state, wherein the update amount setting step sets an update amount when the internal combustion engine is in the idle state that is smaller than when the internal combustion engine is not in the idle state.

10. A method according to claim 6, wherein the purge correction amount calculation step, the correction amount is gradually decreased when stopping the purging.

11. A computer-readable storage medium containing program instructions for performing:

a fuel supply step of supplying fuel to the internal combustion engine;

a purge step of purging fuel vapor, produced in a fuel tank, into an intake system of the internal combustion engine;

a purge correction amount calculating step of calculating a purge correction amount for correcting an amount of fuel to be supplied in the fuel supply step, depending on the amount of fuel vapor purged in the purge step;

a target air-fuel ratio setting step of setting a target air-fuel ratio, including an air-fuel ratio leaner than the stoichiometric air-fuel ratio, depending on a running state of the internal combustion engine; and an update amount setting step of updating the purge correction amount depending on the target air-fuel ratio set in the target air-fuel ratio setting step.

12. A computer-readable storage medium according to claim 11, wherein the program instructions further perform:

an air-fuel ratio detection step of detecting an actual air-fuel ratio in an exhaust system of the internal combustion engine and generating an electric signal proportional to the actual air-fuel ratio to be used in the update amount setting step, wherein in the update amount setting step, the update amount is set so as to become larger as a deviation between the air-fuel ratio detected in the air-fuel ratio detection step and the target air-fuel ratio becomes larger.

13. A computer-readable storage medium according to claim 11, wherein the program instructions further perform:

an idle determination step of determining whether the internal combustion engine is in an idle state; and a load change detection step of detecting a change in a load of the internal combustion engine, wherein the update amount setting step comprises a purge-correction-amount initialization step of initializing a purge correction amount for correcting the amount of fuel when it is determined in the idle determination step that the internal combustion engine is in the idle state and when it is determined in the load change detection step that there is a change in the load.

14. A computer-readable storage medium according to claim 11, wherein the program instructions further perform:

an idle determination step of determining whether the internal combustion engine is in an idle state, wherein the update amount setting step sets an update amount when the internal combustion engine is in the idle state that is smaller than when the internal combustion engine is not in the idle state.

15. A computer-readable storage medium according to claim 11, wherein in the purge correction amount calculation step, the correction amount is gradually decreased when stopping the purging.

* * * * *